US011608601B2

(12) United States Patent
Marandos et al.

(10) Patent No.: US 11,608,601 B2
(45) Date of Patent: Mar. 21, 2023

(54) SOUND ATTENUATION BARRIER WITH IMPROVED EASE OF ASSEMBLY

(71) Applicant: Aus Group Alliance Pty Ltd, Melbourne (AU)

(72) Inventors: Nicholas Marandos, Melbourne (AU); Graeme Peter Hall, Melbourne (AU)

(73) Assignee: Aus Group Alliance Pty Ltd, Melbourne (AU)

( * ) Notice: Subject to any disclaimer, the term of this patent is extended or adjusted under 35 U.S.C. 154(b) by 286 days.

(21) Appl. No.: 16/607,912

(22) PCT Filed: Apr. 27, 2018

(86) PCT No.: PCT/AU2018/050389
§ 371 (c)(1),
(2) Date: Oct. 24, 2019

(87) PCT Pub. No.: WO2018/195605
PCT Pub. Date: Nov. 1, 2018

(65) Prior Publication Data

US 2021/0102349 A1 Apr. 8, 2021

(30) Foreign Application Priority Data

Apr. 27, 2017 (AU) ..... 2017901530

(51) Int. Cl.
*E01F 8/00* (2006.01)
*E04B 2/14* (2006.01)
*E04B 2/20* (2006.01)

(52) U.S. Cl.
CPC ..... *E01F 8/0017* (2013.01); *E01F 8/0023* (2013.01); *E01F 8/0011* (2013.01); *E01F 8/0064* (2013.01)

(58) Field of Classification Search
CPC ..... E01F 8/00; E01F 8/0017; E01F 8/0011; E01F 8/0005; E04B 2001/8423;
(Continued)

(56) References Cited

U.S. PATENT DOCUMENTS 2,999,568 A 9/1961 Ludwig et al.
3,037,593 A 6/1962 Webster
(Continued)

FOREIGN PATENT DOCUMENTS

CA 2 248 428 9/1998
EP 0 041 181 12/1981
(Continued)

OTHER PUBLICATIONS

QueenslandRail, Systems and Capability Technical Requirement, "Design of Noise Barriers Adjacent to Railways", Sep. 30, 2010.
(Continued)

*Primary Examiner* — Edgardo San Martin
(74) *Attorney, Agent, or Firm* — Knobbe, Martens, Olson & Bear, LLP

(57) ABSTRACT

Embodiments relate to a plastic wall panel, comprising a hollow body having external walls and defining an internal cavity. The external walls include: a first major side wall, a second major side wall opposite the first major side wall, a minor top wall, a minor bottom wall, a first minor end wall and a second minor end wall opposite the first minor end wall. The minor top wall and the minor bottom wall each define mating structure to mate and align with another adjacent panel so that multiple panels can be tiled together to form at least part of a sound attenuation barrier. The hollow body defines a passage extending between the first and second major side walls and through the first and second minor end walls to receive a reinforcing beam.

21 Claims, 27 Drawing Sheets

(58) Field of Classification Search
CPC ..... E04B 2001/8447; E04B 1/84; E04B 1/86; E04B 2/14; E04B 2/20
See application file for complete search history.

(56) References Cited

U.S. PATENT DOCUMENTS 3,627,362 A 12/1971 Brenneman
3,656,576 A * 4/1972 Gubela ..... E01F 8/007 181/210
3,662,410 A 5/1972 Lankheet
4,146,113 A * 3/1979 Gavel ..... E01F 8/0035 181/210
4,160,491 A 7/1979 Matsumoto et al.
4,292,015 A 9/1981 Hritz
4,743,485 A * 5/1988 Ting ..... B29C 44/56 428/109
4,749,533 A 6/1988 Payne
4,852,310 A 8/1989 Henley et al.
4,984,406 A 1/1991 Friessen
5,040,352 A 8/1991 Oberlander et al.
5,150,993 A 9/1992 Miller
5,217,771 A 6/1993 Schmanski et al.
5,239,798 A 8/1993 Saito
5,271,338 A 12/1993 Bonham
5,272,284 A 12/1993 Schmnski
5,372,866 A 12/1994 Oberlander et al.
5,379,561 A 1/1995 Saito
5,459,971 A 10/1995 Sparkman
5,485,703 A 1/1996 Nordahl
5,560,630 A 10/1996 Phares et al.
5,564,586 A 10/1996 Goodwin
5,702,090 A 12/1997 Edgman
5,941,041 A 8/1999 Robinson et al.
6,178,713 B1 1/2001 Delie
6,180,203 B1 1/2001 Unkles
6,412,597 B1 7/2002 Schola et al.
6,609,339 B1 8/2003 Pardue
6,637,728 B2 10/2003 Pettit et al.
6,679,021 B2 1/2004 Maimon et al.
6,719,277 B2 4/2004 Ohanesian
6,745,537 B1 6/2004 Hamilton
6,899,200 B1 5/2005 Roberts et al.
7,220,077 B2 5/2007 Humphries et al.
7,240,637 B2 7/2007 Rosen
7,478,797 B2 1/2009 Laws et al.
7,549,263 B1 6/2009 Porter
7,635,114 B2 12/2009 Laws et al.
7,665,574 B2 2/2010 Schoela et al.
7,677,007 B2 3/2010 Parker
7,726,633 B2 6/2010 Cook et al.
7,739,846 B2 6/2010 Garrett
7,992,678 B2 * 8/2011 Pilaar ..... B32B 3/06 181/284
8,161,711 B2 4/2012 Steed et al.
8,176,697 B1 5/2012 Bolander, II
8,196,365 B2 6/2012 Parshad
8,469,144 B2 * 6/2013 Pilaar ..... B32B 27/08 181/284
8,511,648 B2 8/2013 McCarthy et al.
8,544,601 B2 * 10/2013 Chae ..... E04B 1/86 181/293
8,561,360 B2 10/2013 Corbin, Jr.
8,579,080 B2 11/2013 Angelico
8,651,232 B2 2/2014 Kedar et al.
9,091,069 B2 7/2015 Marandos et al.
9,499,978 B2 11/2016 Glancy
9,714,110 B2 7/2017 Veltrop et al.
9,803,372 B2 10/2017 Griffiths et al.
D865,224 S * 10/2019 Harrison ..... D25/155
10,472,825 B2 11/2019 Marandos et al.
11,047,135 B2 6/2021 Marandos et al.
2001/0009703 A1 7/2001 Toshikawa
2002/0000545 A1 1/2002 Pettit et al.
2002/0094399 A1 7/2002 Rhodes, Jr. et al.
2003/0019170 A1 1/2003 Donnelly
2004/0045488 A1 3/2004 Danzik et al.
2004/0121100 A1 6/2004 Potempa
2005/0126852 A1 6/2005 Nakajima et al.
2007/0131480 A1 6/2007 Corbin et al.
2007/0158629 A1 * 7/2007 Laws ..... E04H 17/168 256/24
2008/0010927 A1 1/2008 Wilson et al.
2009/0056257 A1 3/2009 Mollinger et al.
2009/0193735 A1 8/2009 Kalinowski
2010/0154331 A1 6/2010 Dickens
2010/0243369 A1 9/2010 Fusiek et al.
2011/0167749 A1 7/2011 Azizi
2016/0102462 A1 4/2016 Griffiths et al.
2020/0071931 A1 3/2020 Marandos et al.
2020/0385982 A1 12/2020 Rivas et al.
2021/0363712 A1 * 11/2021 Wilson ..... E04H 17/1456

FOREIGN PATENT DOCUMENTS

EP 2 466 010 6/2012
FR 2 267 603 11/1975
FR 2 899 257 5/2007
GB 1 087 713 10/1967
KR 10-1331408 11/2013
KR 10-1399289 5/2014
WO WO 1997/038839 10/1997
WO WO 1999/019574 4/1999
WO WO 2000/042255 7/2000
WO WO 2005/014947 2/2005
WO WO 2005/085544 9/2005
WO WO 2015/089586 6/2015
WO WO 2018/161122 9/2018

OTHER PUBLICATIONS

International Search Report issued in PCT Application No. PCT/AU2018/050389, dated Jul. 30, 2018, in 5 pages.

* cited by examiner

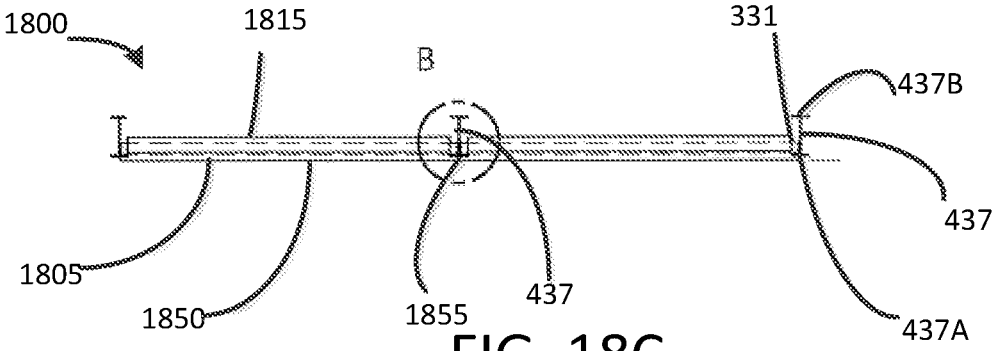
FIG. 18C
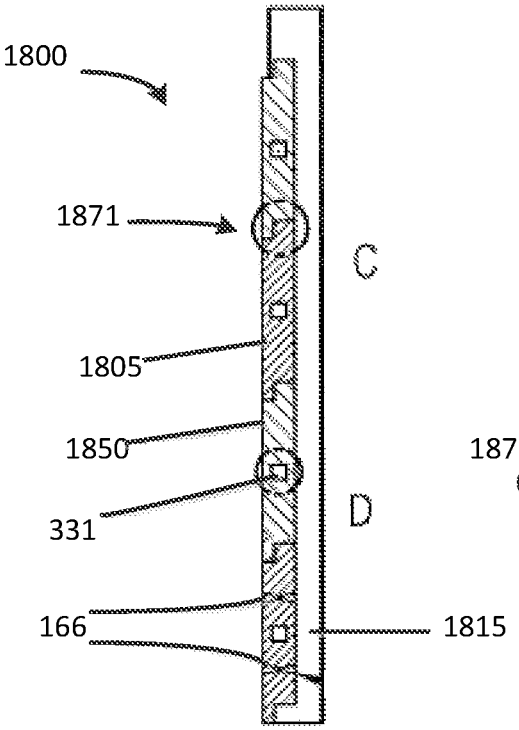
FIG. 18E
FIG. 18D
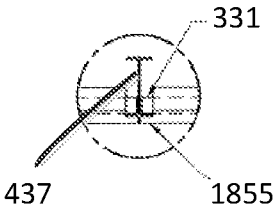
FIG. 18F
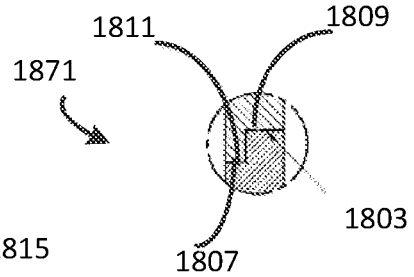
FIG. 18G
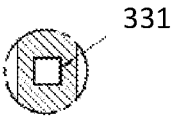

SOUND ATTENUATION BARRIER WITH IMPROVED EASE OF ASSEMBLY

CROSS-REFERENCE TO RELATED APPLICATIONS

This application is a United States national stage application under 35 U.S.C. § 371 of PCT Application No. PCT/AU2018/050389 designating the United States, filed on Apr. 27, 2018, which is hereby incorporated by reference in its entirety and which claims priority to Australian Patent App. No. 2017901530, filed on Apr. 27, 2017.

TECHNICAL FIELD

The described embodiments relate generally to plastic panels and barriers or other structures using such panels and methods of their formation. In particular, embodiments relate to plastic panels suitable for use in sound attenuation barriers or other wall structures. The plastic panels may be generally hollow.

BACKGROUND

Sound attenuation barriers are used internationally to attenuate the transmission of noise from a noisy area, such as a roadway, a railway, an industrial site or other high noise area. Such barriers are generally required to provide a certain specified degree of attenuation of noise passing from one side of the barrier to the other.

Sound attenuation barriers commonly include support structure anchored to the ground and a series of panels spanning the support structure to provide a continuous barrier along a desired distance. In some instances, such sound attenuation barriers must extend for a number of kilometres. Commonly, the panels used in existing sound attenuation barriers are formed of wood, concrete and/or steel. These panels are formed at a remote site, transported to the place where the barrier is to be erected, then affixed relative to the support structure to form the sound attenuation barrier. Steel panels are heavy and expensive and subject to graffiti. Wood panels are subject to burning, are more prone to deterioration and need significant maintenance. Concrete panels are quite heavy and can be prone to cracking or chipping. As it is commonly preferred to have sound attenuation barriers provide an aesthetically appealing appearance, cracking or chipping of the panels is undesirable and the panel manufacturer may be required to replace any such damaged panel at its own cost. Further, concrete panel forming processes provide only limited flexibility to confer an appealing aesthetic appearance on an external face of the panel.

Another problem encountered in relation to sound attenuation barriers is the potential for vandalism, such as spray painted graffiti. Removal of graffiti from concrete panels can be problematic and expensive. Similarly, where a sound attenuation barrier is adjacent an area that throws up air-born particulate, such as a roadway, airborne pollutants commonly accrete onto the panels over time and need to be cleaned in order maintain an aesthetically pleasing appearance. For some panel materials, it can be hard to clean the pollutants from the panel surfaces.

Furthermore, because these sound attenuation barriers are formed of wood, concrete and/or steel, they are difficult to transport and assemble, with each panel requiring significant machine powered alignment and assembly. Also if a specific panel in a barrier needs to be repaired or replaced, the process of disassembling the barrier requires both significant manual effort and machine powered disassembly. Because of the relative large size of the panel, the construction process also requires significantly large sized equipment that is both more expensive and difficult to transport.

It is desired to address or ameliorate one or more shortcomings or disadvantages associated with prior techniques for sound attenuation barriers and panels, or to at least provide a useful alternative thereto.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

SUMMARY

Some embodiments relate to a plastic wall panel, comprising: a hollow body having external walls and defining an internal cavity, the external walls including: a first major side wall, a second major side wall opposite the first major side wall, a minor top wall, a minor bottom wall, a first minor end wall and a second minor end wall opposite the first minor end wall; wherein the minor top wall and the minor bottom wall may each define a mating structure to mate and align with another adjacent one of the panel so that multiple ones of the panel can be tiled together to form at least part of a sound attenuation barrier, and wherein the hollow body may define a passage extending between the first and second major side walls and through the first and second minor end walls to receive a reinforcing beam.

The passage in some embodiments may be a first passage and the hollow body may further define a second passage wherein the hollow body defines a passage extending between the first and second major side walls and through the first and second minor end walls to receive a reinforcing beam. The first and second minor end walls may have a first length that is less than a second length of the minor top wall and the minor bottom wall. In some embodiments, the second length may be between 2 and 6 times greater than the first length. The panels may be rotationally moulded.

The panels may comprise the reinforcing beam received in the passage and extending through the first and second minor end walls. The reinforcing beam may be slidingly received in the passage without being affixed in position. The passage may be open to the cavity inside the panel.

The panel may comprise at least one bridging portion where the first major side wall meets the second major side wall, the at least one bridging portion being located between the minor bottom and top walls and between the first and second minor end walls. The first major side wall may be formed to define a front face and the second major side wall may be formed to define a back face, wherein the first and second minor end walls may each define respective first and second projecting flanges that extend laterally beyond a lateral extent of the back face. The first and second projecting flanges may extend approximately in or parallel to a plane of the front face.

The first and second minor end walls may define respective first and second beam apertures to receive the reinforcing beam in a clearance fit, wherein a spacing between the first beam aperture and the first projecting flange may be arranged to receive a support flange of a support structure in a clearance fit.

Some embodiments relate to a plastic wall panel, comprising: a hollow body having external walls and defining an internal cavity, the external walls including: a first major side wall, a second major side wall opposite the first major side wall, a minor top wall, a minor bottom wall, a first minor end wall and a second minor end wall opposite the first minor end wall; wherein the hollow body may define a passage extending between the first and second major side walls and through the first and second minor end walls to receive a reinforcing beam; wherein the first minor end wall may have a different shape from the second minor end wall, the second minor end wall defining mating structure to mate and align with corresponding mating structure of the second minor end wall of another adjacent one of the panel so that multiple ones of the panel can be tiled together to form at least part of a sound attenuation barrier.

The first and second minor end walls may have a first length that is greater than a second length of the minor top wall and the minor bottom wall. The first length may be between about 1.5 and about 4 times greater than the second length. The first major side wall may be formed to define a front face and the second major side wall may be formed to define a back face, wherein the first and second minor end walls may each define a respective first and second projecting flanges that extend laterally beyond at lateral extent of the back face.

Some embodiments relate to a panel assembly comprising a plurality of panels, wherein when a panel is mated and aligned with the another panel, the passage of the panel is aligned and communicates with the passage of the another panel so that the reinforcing beam is receivable through both passages.

Some embodiments relate to a wall section that comprises first and second ones of the plastic wall panel. The mating structure of the first panel may be mated and aligned with the mating structure of the second panel. The reinforcing beam may be received through the passage of each of the first and second panels. The reinforcing beam may be a first reinforcing beam and the passage may be a first passage and the hollow body of each panel may define a second passage spaced from the first passage, the second passage may receive a second reinforcing beam in a substantially parallel orientation with the first reinforcing beam. The first and second passages may extend through spaced upper and lower central regions of the cavity.

Some embodiments relate to a method of forming a barrier, comprising arranging a reinforcing beam to extend through the passage of each of a plurality of the panels and positioning each of the panels in tiled and slotted relation to flanged vertical supports, wherein a plurality of the panels may be held in vertical positions by a flange of the flanged vertical support being received between an end flange of the panel and the reinforcing beam.

BRIEF DESCRIPTION OF DRAWINGS

Embodiments are described in further detail below, by way of example, with reference to the accompanying drawings, in which:

FIG. 18C is the top view of the sound attenuation barrier of FIGS. 18A and 18B;

FIG. 18D is a detailed view of a section B in FIG. 18C;

FIG. 18E is a cross section view of a sound attenuation barrier along the A-A line in FIG. 18B;

FIG. 18F is a detailed view of section C of FIG. 18E;

FIG. 18G is a detailed view of section D of FIG. 18E;

DETAILED DESCRIPTION

Figure 1:
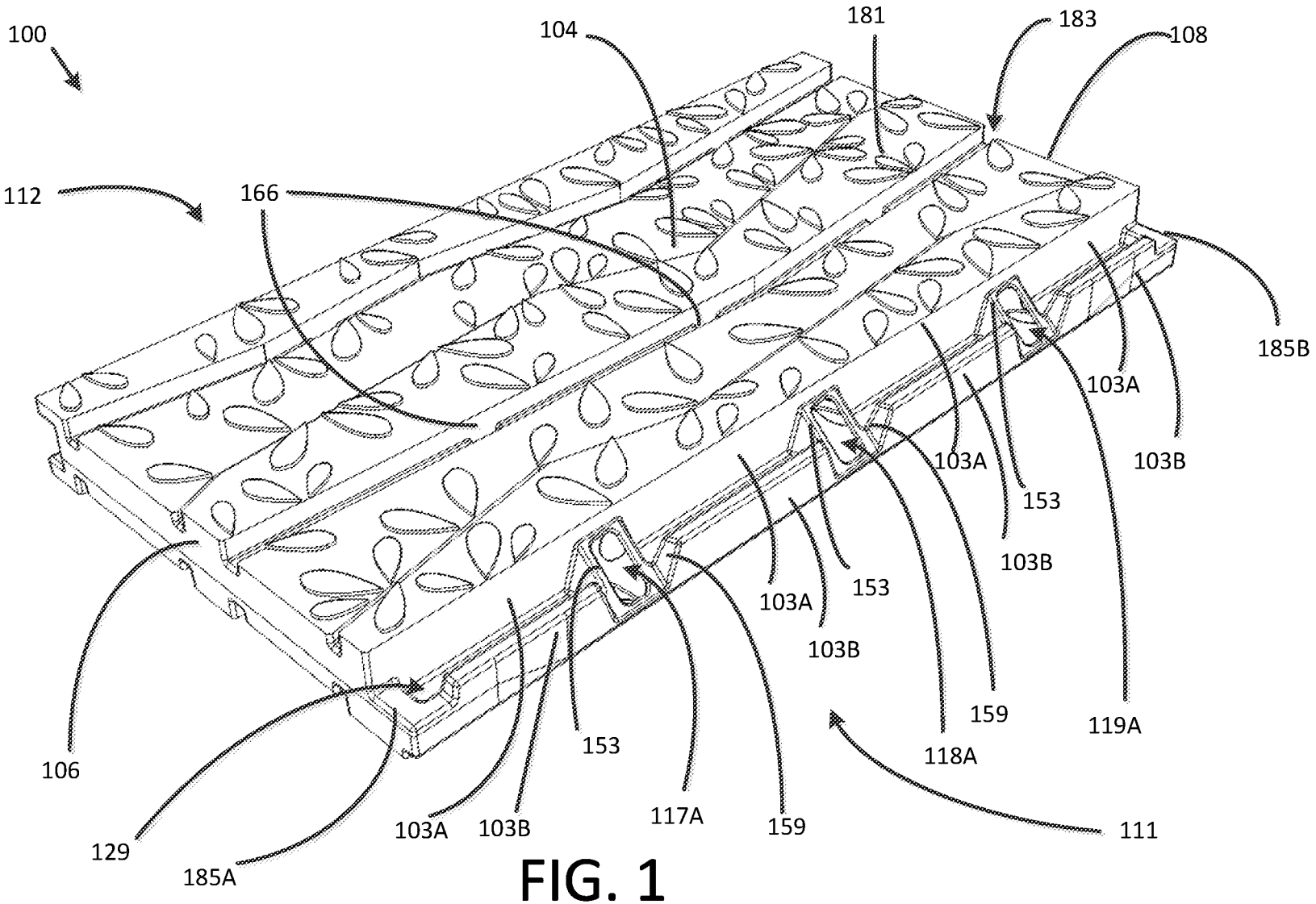
FIG. 1 is a perspective view of a panel according to some embodiments, showing a first major side wall.

Described panels may be formed by rotational moulding techniques using existing rotational moulding technology. Such techniques may involve formation of a mould, addition of plastic granules into the mould, closure of the mould and then simultaneous rotation and heating of the plastic inside the closed mould in order to melt the plastic evenly around the heated surfaces of the mould. Use of rotational moulding techniques in the context of forming embodiments of plastic panels is described herein in more detail in relation to FIG. 19 below.

Described panels can be used to form walls or barriers or to form part of a building structure, for example. In some embodiments, described panels can be used together with support structures to form sound attenuation barriers that can extend for hundreds of metres and possibly kilometres. When used for such sound attenuation barriers, described panels provide for a lighter, less expensive and more easily transportable form of panel than the concrete panels of the prior art. The described panels are in the shape of a hollow body with external walls defining an internal cavity. The internal cavity provided in the described panels may act as a medium for sound wave dissipation thereby enhancing the sound attenuation properties of the described panels.

Referring now to FIGS. 1, 2, 3 and 4, a panel 100 according to some embodiments will now be described in further detail. Panel 100 comprises: a first major side wall 104; a second major side wall 102 (shown in FIG. 6B); a first minor end wall 105 at a first end 112; a second minor end wall 103 (substantially parallel to the first end wall 105) formed by the end wall 103A and a series of projecting tongues 103B at a second end 111; a minor bottom wall face 106; and a minor top wall face 108. The bottom and top ends the wall 103A and the projecting tongue 103B are bounded by the L-shaped edges 185A and 185B. The projecting tongue 103B along with L-shaped edges 185A and 185B and end wall 103A define a valley 129 on the second minor end 111. The valley 129 may be 30 to 100 mm wide as measured between the inner face of the projecting tongue 103B and the end wall 103A, for example. The width of the projecting tongue 103B is accordingly chosen to be marginally smaller than the width of the valley 129 to allow the valley 129 to receive the projecting tongue in a clearance fit or a looser fit that allows for some small amount (a few millimetres) of movement between two adjacent mated panels 100. The second minor end wall 103 comprises a plurality, such as two, three or four, projecting structures 153 that project from end wall 103A in an angled manner toward the projecting tongues 103B.

The projecting structures 153 may be shaped as triangular wedges and apertures 117A, 118A and 119A may be formed in an outward angled face of the projecting structures 153. Adjacent where the projecting structures 153 separate the tongue portions 103B are respective valleys defined by sloping edges 159 at each lengthwise end of each tongue portion 103B. The sloping edges 159 create breaks in the projecting tongue portions 103B wherein the projecting structures 153 are positioned. Measured along the lengthwise end of face 103, projecting structures 153 may have a width of 30 to 70 mm, for example.

On the first minor end 112, panel 100 has corresponding apertures 117B, 118B and 119B. A reinforcing beam may be received through the apertures 117A, 118A or 119A and pass through the passage between the first and second major side walls to extend from the apertures 117B, 118B or 119B. The apertures 117A-117B, 118A-118B and 119A-119B form continuous passages. These passages may not be specifically defined by wall faces within the panel and may be a part of the overall cavity inside the panel 100. These passages are substantially parallel to each other and also substantially parallel to the bottom wall face 106 and the top wall face 108.

Figure 3:
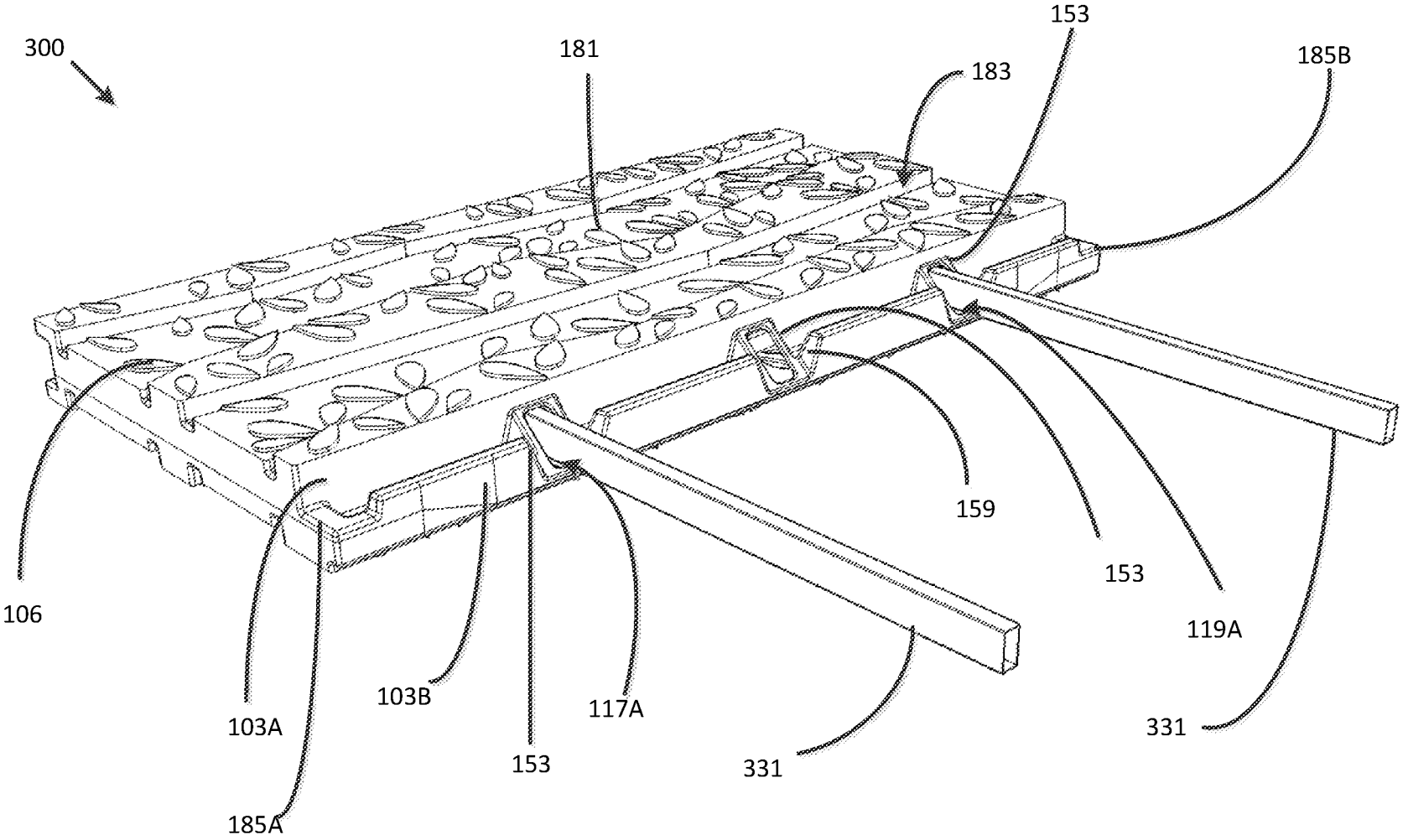
FIG. 3 is a perspective view of the panel of FIG. 1, shown receiving two reinforcement beams through apertures in end walls of the panel.
Figure 4:
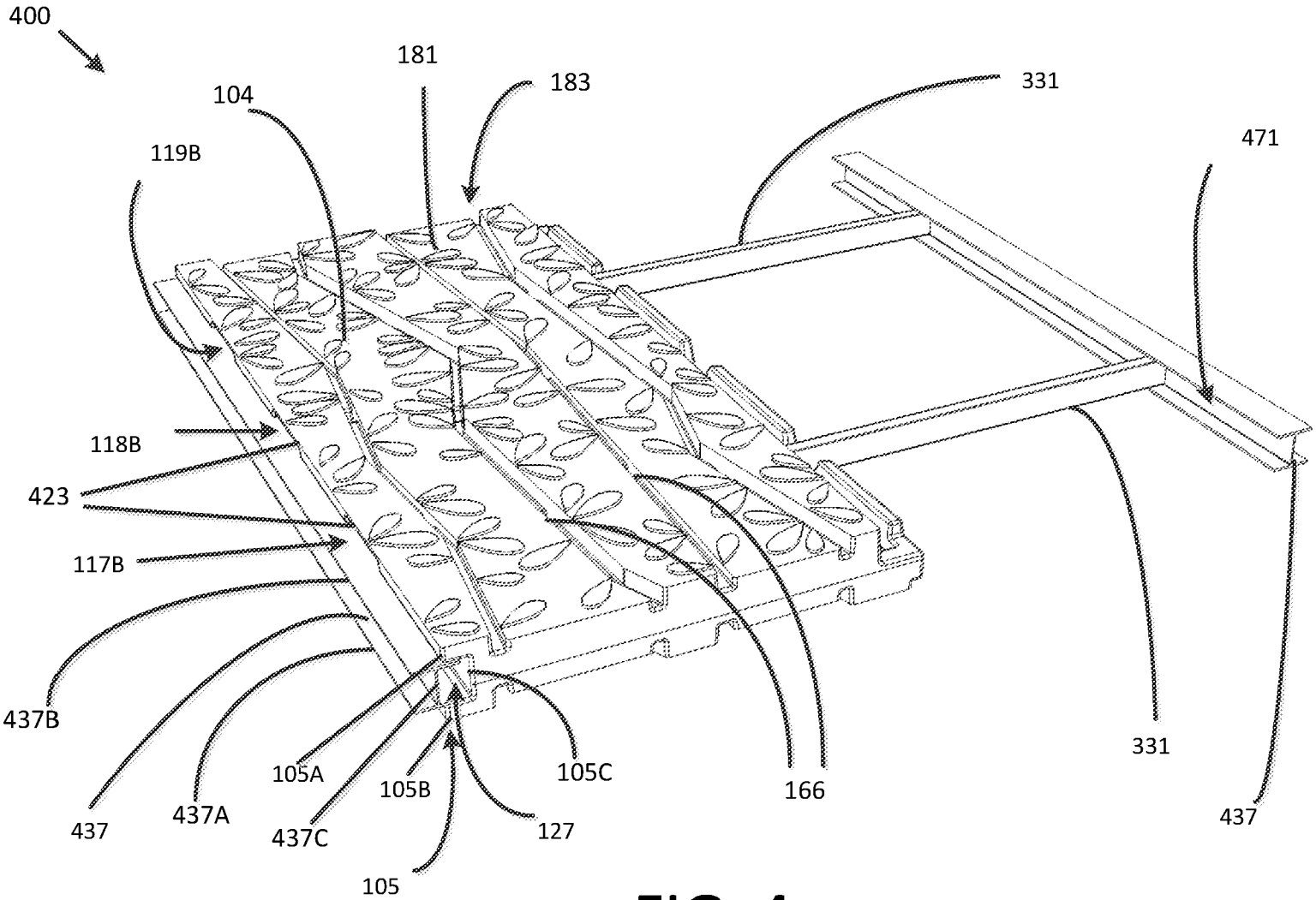
FIG. 4 is a perspective view of the panel of FIG. 1, arranged with respect to two reinforcement beams and two support beams.

Described panel embodiments may employ reinforcing beams, for example such as a reinforcing beam 331 received through apertures 117A and 119A in a clearance fit in FIGS. 3 and 4. The reinforcing beams can project from apertures 117B and 119B as shown in FIGS. 3 and 4. Reinforcing beams 331 are in the form of an elongate bar which may be formed of steel or another suitable metal, for example. The elongate bar may be a steel rectangular hollow section (RHS), for example. Embodiments may have one or more reinforcing beams depending on the extent of structural support necessary reinforce the panels. The cross section of the reinforcing beams 437 in the shape of a RHS may be 30 to 50 mm in width and 50 to 70 mm in length, for example. The size of the apertures 117A, 117B, 118A, 118B, 119A and 119B is accordingly chosen to be marginally greater than the dimensions of the reinforcing beam 331 to receive the reinforcing beam 331 in a clearance fit. The gap between the reinforcing beam and the wall of the panel 100 that forms the aperture may be padded with a cushioning element, such as a film, layer or ring to absorb and/or reduce vibration of the panel 100 with respect to the reinforcing beam 331. Thus, such a cushioning element can assist in closing or minimising gaps between the reinforcing beam 331 and the walls of the projecting structures 153 that define the apertures 117A, 118A, 119A, to thereby minimise potential rattling of the panel relative to the reinforcing beam 331 under windy conditions.

Figure 2:
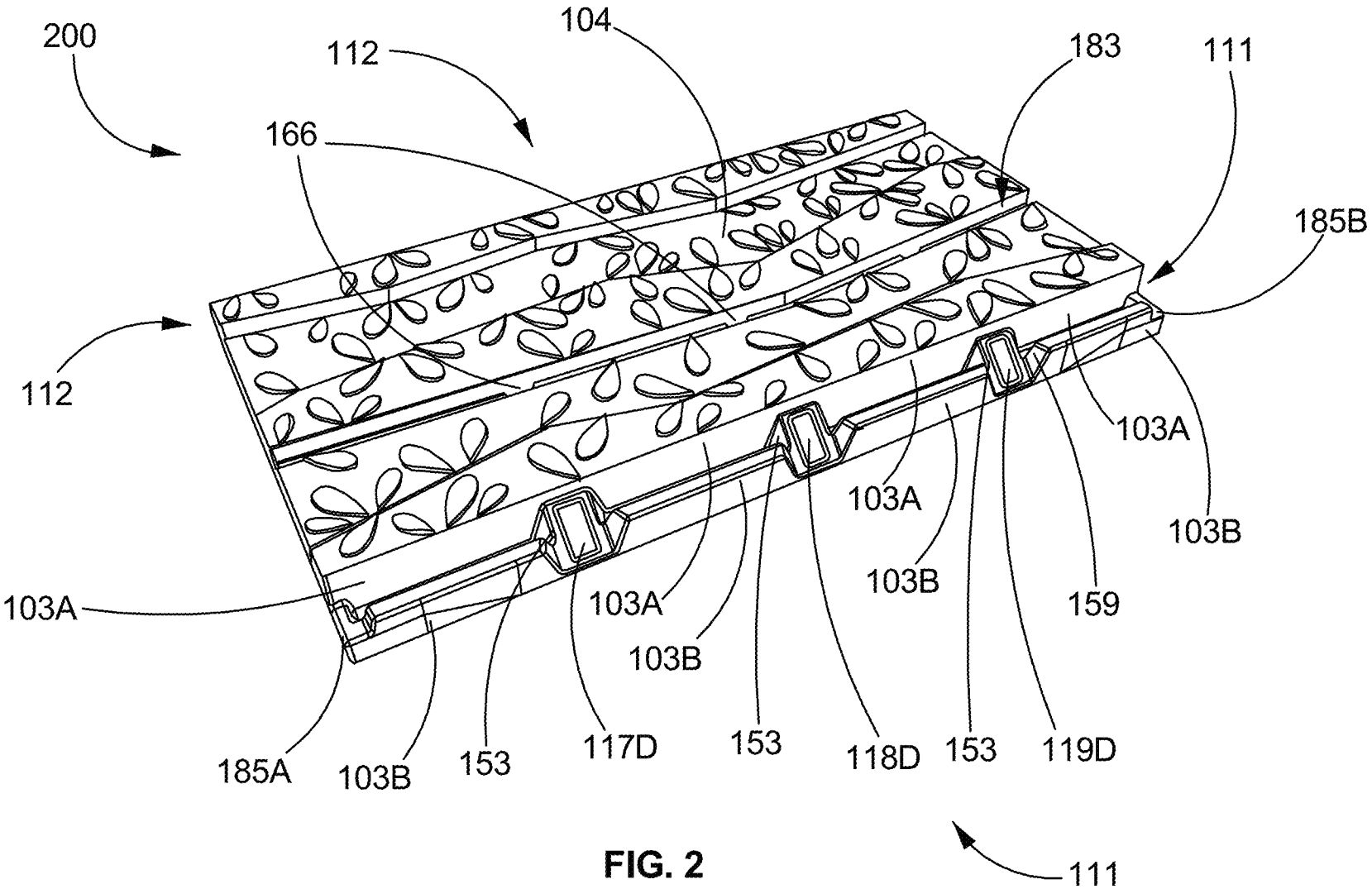
FIG. 2 is another perspective view of the panel of FIG. 1 wherein apertures in end walls of the panel have not been formed yet.

FIG. 2 represents a newly moulded panel 200 wherein the apertures 117A, 118A and 119A have not yet been formed and depending on the number of reinforcing beams necessary to support the panel 100, an appropriate number of apertures may be formed (i.e. cut or punched) in the second end 111 of the panel 100. Wall regions 117D, 118D and 119D in the panel of FIG. 2 may be cut out to form apertures 117A, 118A, 119A. For example, if only two beams 331 are required, then only apertures 117A and 119A may be formed by removing the wall regions 117D and 119D, leaving in place the wall region 118D to occlude (or just not create) aperture 118A. FIG. 3 shows a partial panel assembly 300 that comprises the panel 100 receiving two reinforcing beams 331 in the apertures 117A and 119A. Partial panel assembly 300 would not normally be used as shown, since the panel 100 would first be mated with another panel 100 prior to the reinforcing beams 331 being passed through the passages of the panels 100 to keep the panels 100 together, but FIG. 3 nevertheless serves to illustrate how the reinforcing beams 331 are received in the apertures 117A, 119A and extend through the interior passages between the first and second ends 112, 111.

Face 105 at first end 112 is contoured to define three sub-sections: 105A, 105B and 105C. Sections 105A and 105B are projecting flanges from the face 105 and section 105C forms the base of the face 105. A channel or valley 127 is defined by 105A, 105B and 105C on three sides. The panel 100 can be held in place by a supporting beam 437 that is received in the valley 127 between the projecting flanges 105A and 105B as shown in FIG. 4 to show a further partial panel assembly 400. Partial panel assembly 400 would not normally be used as shown, since the panel 100 would first be mated with another panel 100 prior to the reinforcing beams 331 being passed through the passages of the panels 100 and the reinforcing beams being fitted into side recesses of the vertical support beams 437. However, FIG. 4 nevertheless serves to illustrate how the reinforcing beams 331 are received in the side recesses of the vertical support beams 437 and how the outer flanged sections of the first end 112 fit around and partially cover the flanges 437A, 437B of the vertical support beams 437.

The supporting beam 437 is in the shape of an I-beam with flanges 437A and 437B and a web 437C. The ends of the flanges 437A and 437B are received in the recess 127 as shown in FIG. 4 to hold the panel 100 in a vertical position without clamping or otherwise affixing the panel to the supporting beam. The extended ends of the projecting flanges 105A and 105B may rest in contact with the exterior faces of the flanges 437A and 437B of the supporting beam 437. The flanges 437A and 437B may be 30 to 80 mm in width as measured between the two ends of the flanges, for example. The distance between the flanges 437A and 437B may be 50 to 120 mm, for example, depending of the width of the web of beam 437. Face 105 has recessed portions 423 surrounding the apertures 117B, 118B and 119B. 423B is the recessed portion adjoining the first side wall 104 and 423A is the recessed portion adjoining the second side wall 102. The recessed portions 423A and 423B may be recessed from the flanges 105A and 105B by 50 to 100 mm, for example. Cushioning elements may be placed in the recessed portions 423. The recessed portions 423 may provide stiffening surface variations along the long end region of the panel 100 and may also provide for better visibility (from above) of the panel area immediately around reinforcing beams 331 during the assembly of a sound attenuation barrier 600 (shown in FIG. 6A).

The panel 100 has a decorative pattern 181 to give a wall formed by the panel an aesthetic visual appearance when assembled. The first major side wall 104 and the second major side wall 102 may have a plurality of grooves or channels 183 that run across the side walls between the minor top wall 108 and the minor bottom wall 106 in an irregular pattern. These channels enable visual changes in the panels due to temperature variations to be relatively hidden. The depth of these channels may be in the range of 5 to 15 mm, for example. These channels may also provide media for sound wave dissipation, enhancing the sound attenuation properties of the panel 100.

Figure 5:
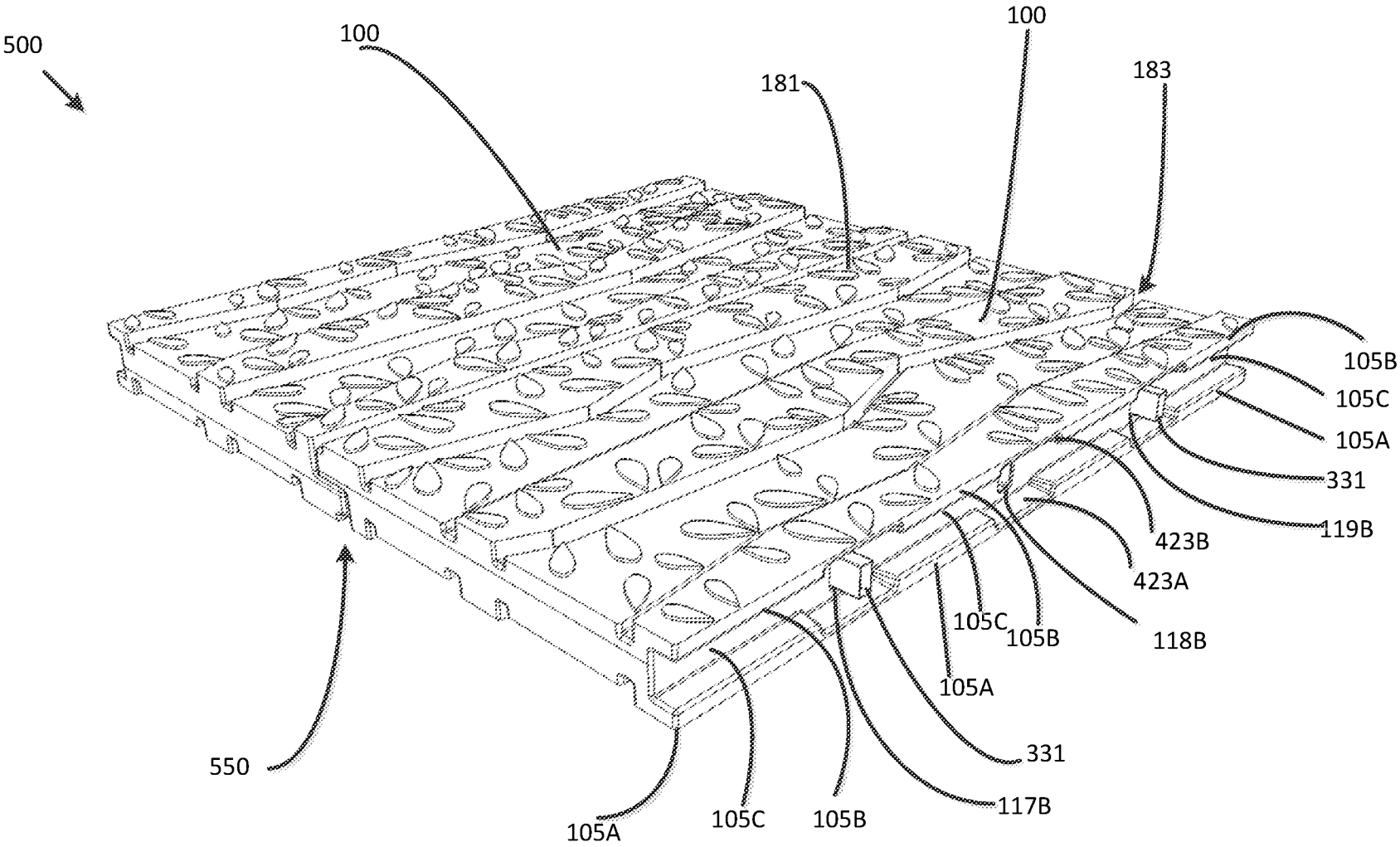
FIG. 5 is a perspective view of a panel assembly, including two of the panels of FIG. 1 mated together and receiving two reinforcing beams.
Figure 6A:
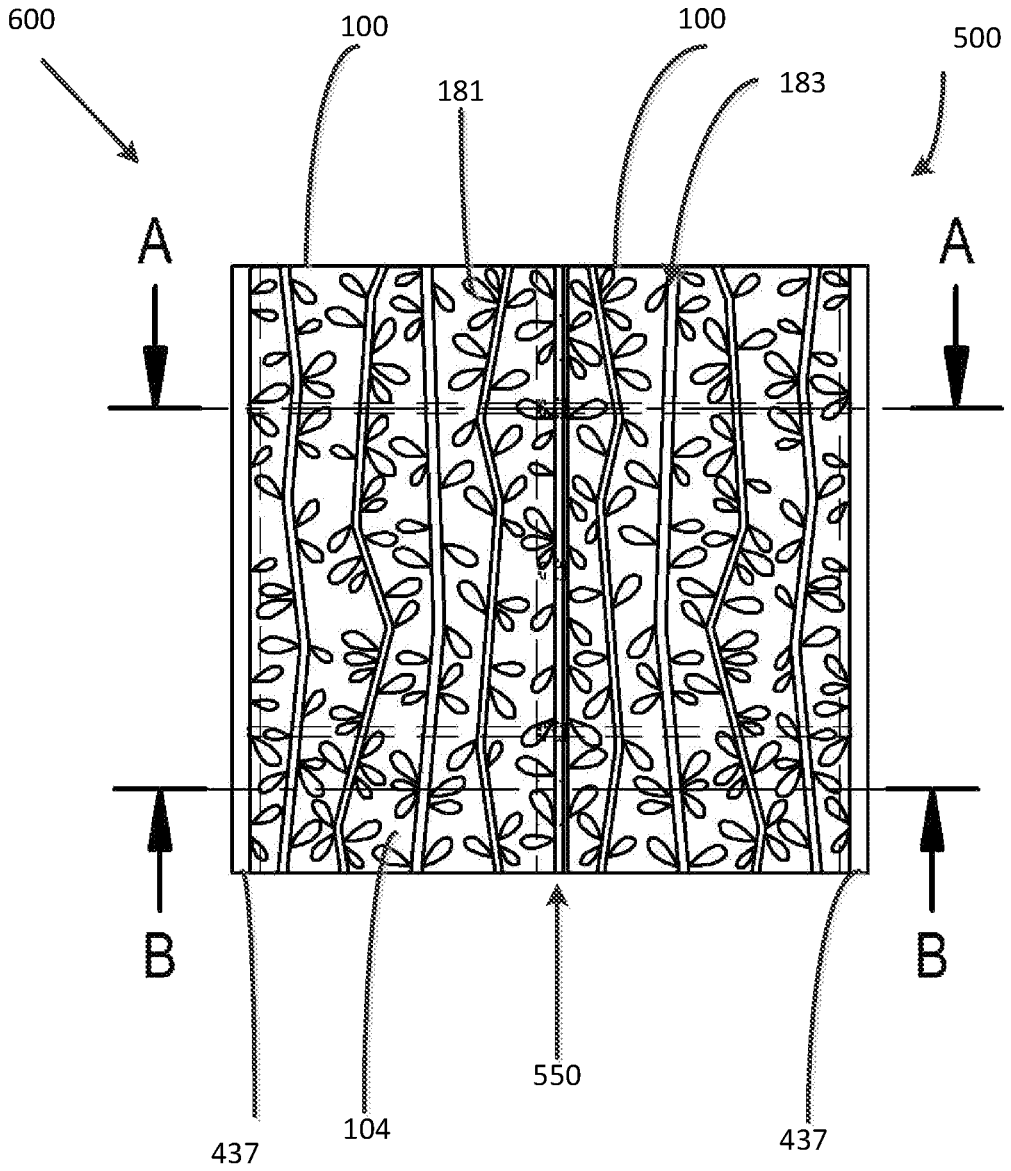
FIG. 6A is the front view of a sound attenuation barrier.
Figure 6B:
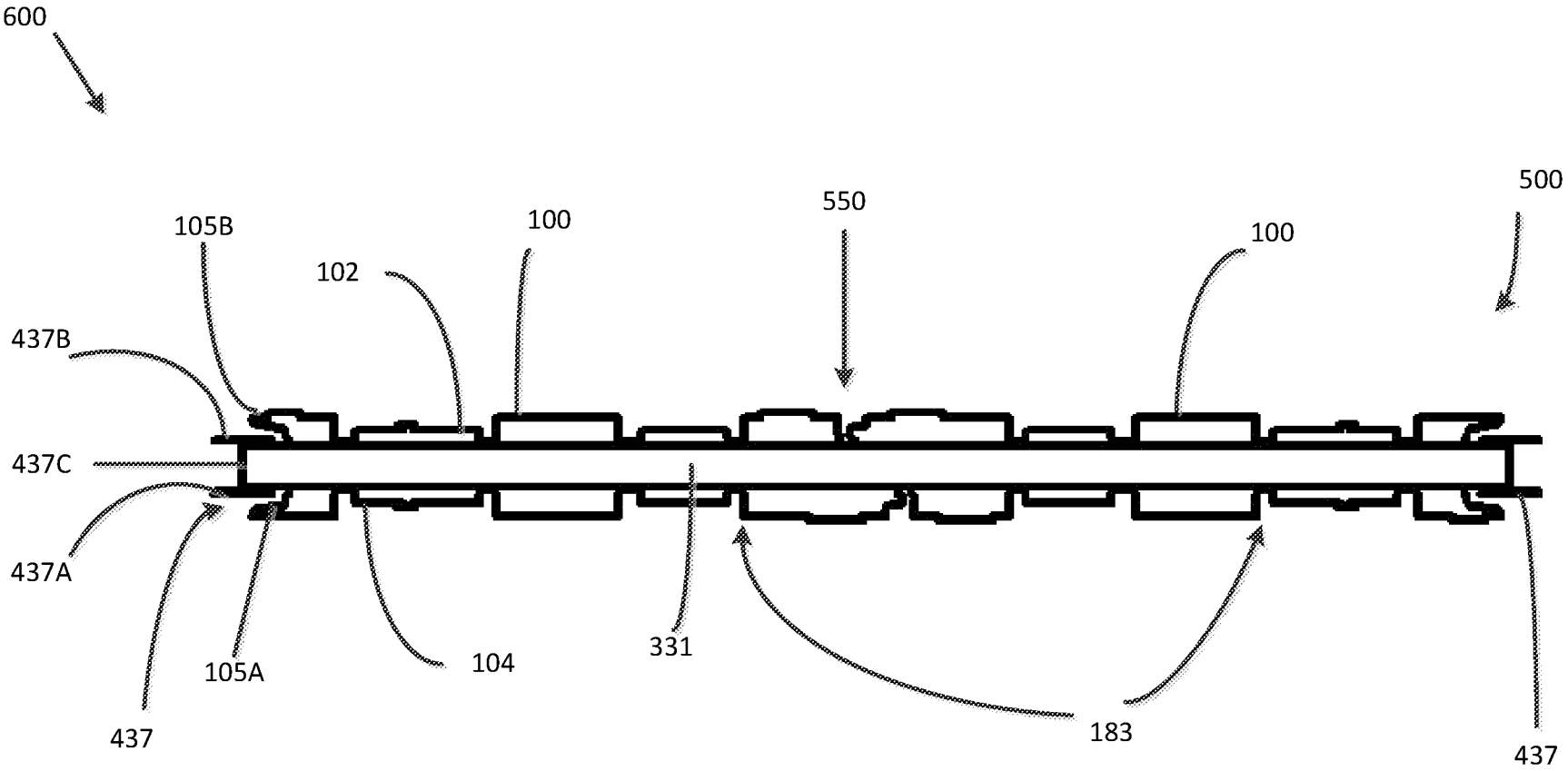
FIG. 6B is an end cross-sectional view of the sound attenuation barrier of FIG. 6A, taken along line B-B.
Figure 6C:
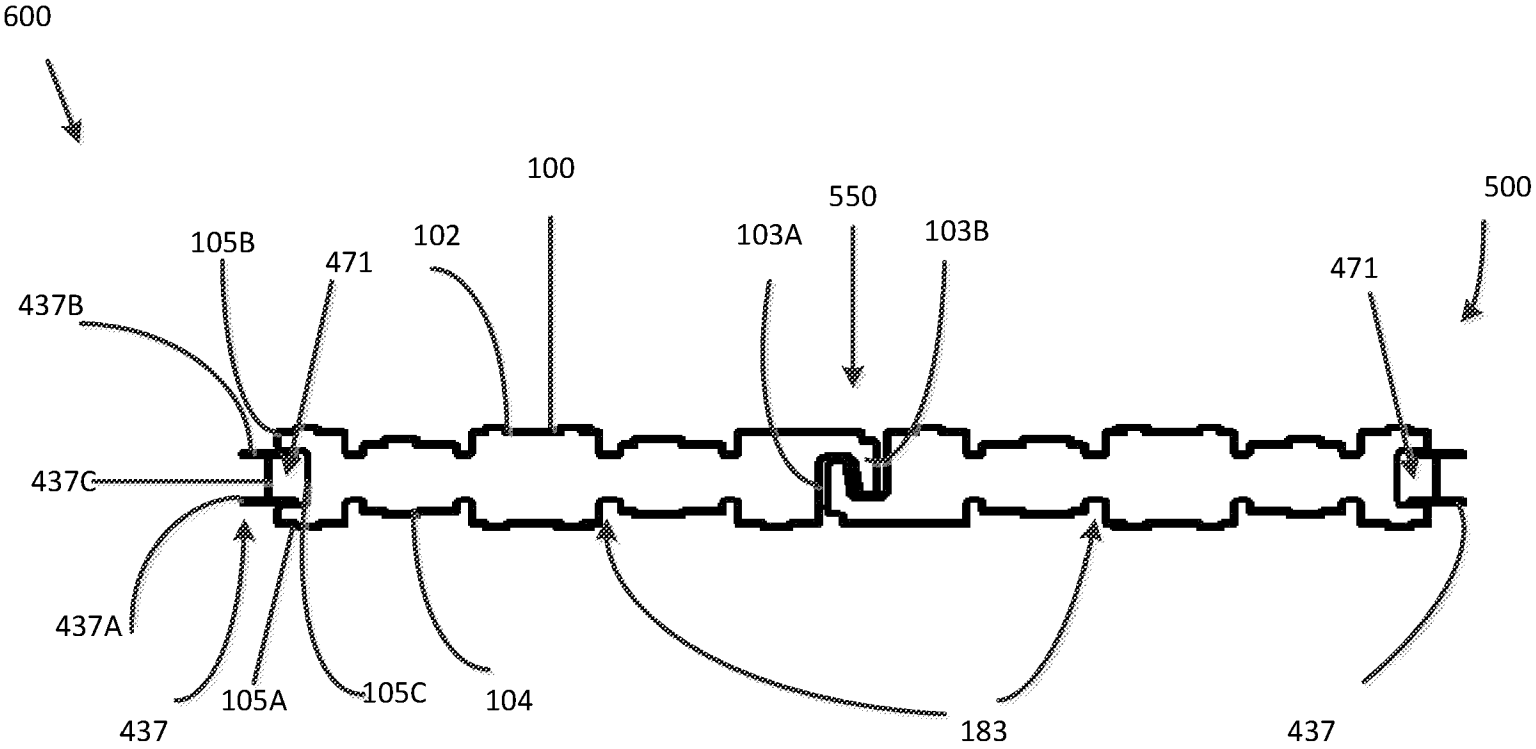
FIG. 6C is an end cross-sectional view of the sound attenuation barrier of FIG. 6A, taken along line A-A.

Referring now to FIGS. 5, 6A, 6B and 6C, a panel assembly 500 according to some embodiments will now be described in further detail. The mating structure defined by the end face 103A and the projecting tongues 103B form a valley 129 therebetween (shown in FIG. 1) that provides a coupling mechanism for two panels. The valley 129 is interrupted along the second minor end wall 103 by the projecting structures 153. The projecting tongue 103B of panel 100 can be aligned inside the recess 129 of another panel to form the panel assembly 500 in FIG. 6A. In this alignment, the projecting structures 153 of the two panels are aligned with each other and the projecting tongue 103B is received in the valley 129 of another panel 100 to align two panels as shown in FIG. 6C. In the aligned arrangement, the projecting structures 153 of the two panels are also aligned with each other to form a continuous passage through the minor end walls 103 and 105 of both the panels. The reinforcing beam 331 may be received in the continuous passage. The reinforcing beam 331 passes through the minor end walls 103 and 105 of the two panels 100 and their respective apertures 117A, 117B, 119A, 119B formed in the mating structures 153 as shown in FIG. 6B. Advantageously, the panels 100 of the panel assembly 500 are effectively locked together by the presence of the two reinforcing beams 331. Thus, in order to separate two mated panels 100 that have received reinforcing beams 331 therethrough (such as are shown in FIG. 5), it is first necessary to withdraw the reinforcing beams 331 from the passages (between apertures 117A and 117B) defined by the panels 100. The panel assembly 500, along with the supporting beams 437, forms a section of a sound attenuation barrier 600.

Figure 11A:
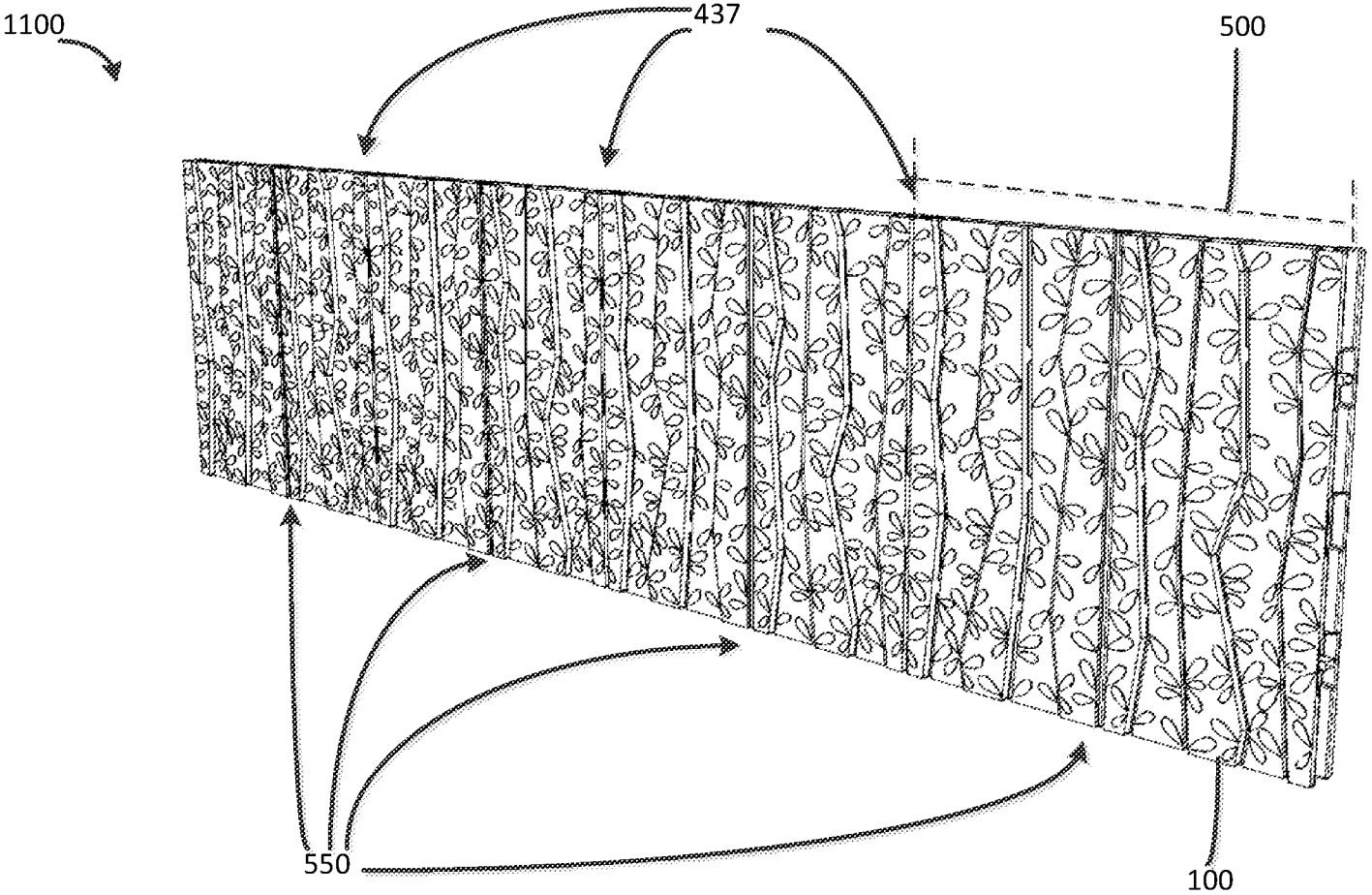
FIG. 11A is a perspective view of a sound attenuation barrier comprising multiple ones of the barriers shown in FIG. 6A.

FIG. 6C shows the mating alignment of two panels 100 from a cross-section view along the B-B line of FIG. 6A. In this diagram, the recess 129 (shown in FIG. 1) between minor end wall 103A and the projecting tongue 103B receives the projecting tongue 103B of another panel to form a panel mating overlay 550 along the length of the face 103 in the panel assembly 500. The recesses 129 and projecting tongues 103B are sized to permit some small separation (movement apart) but to hold the panels 100 in place and effectively stop the two mated panels 100 from coming apart or being pulled apart in longitudinal directions (i.e. by horizontally directed forces when the panel assembly is upright as shown in FIG. 11A).

FIG. 6B is a cross-section view along the A-A line of FIG. 6A. The reinforcing beam 331 passes through the apertures 119A (shown in FIG. 1) and 119B (shown in FIG. 4) of one panel 100 and the apertures 117A (shown in FIG. 1) and 117B (shown in FIG. 4) of another panel 100 to reinforce the panel assembly 500. The reinforcing beam 331 passes through the apertures formed in the projecting structure 153 of both the panels. The support beam 437 has a vertically extending recess 471 defined between opposing flanges that receives the reinforcing beam 331 to hold together the panel assembly 500 between the two supporting beams 437. The supporting beams 437 may extend above top wall faces of panels of the panel assembly 500 to allow multiple panel assemblies to be stacked one on top of another to form the sound attenuation barrier 600. The supporting beams such as 437 are anchored to the ground in a secure manner in order to lend suitable support to the sound attenuation barrier 600 so that large wind forces impinging on the panels are unlikely to displace or perturb the panels or panel assemblies of sound attenuation barrier 600.

Figure 7:
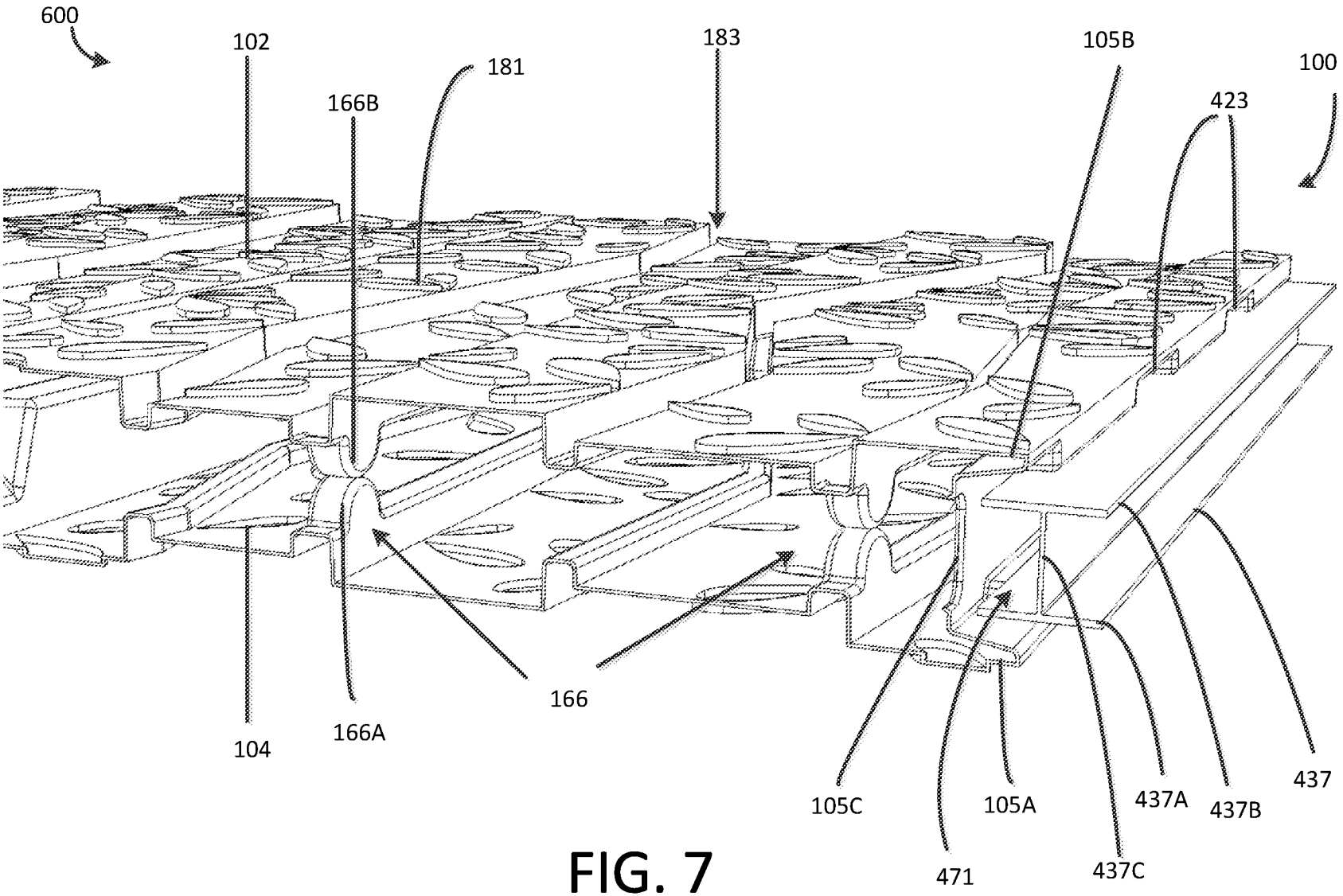
FIG. 7 is a cross-section view of a section of the sound attenuation barrier of FIG. 6A showing a hollow interior cavity of the panel of FIG. 1.
Figure 8:
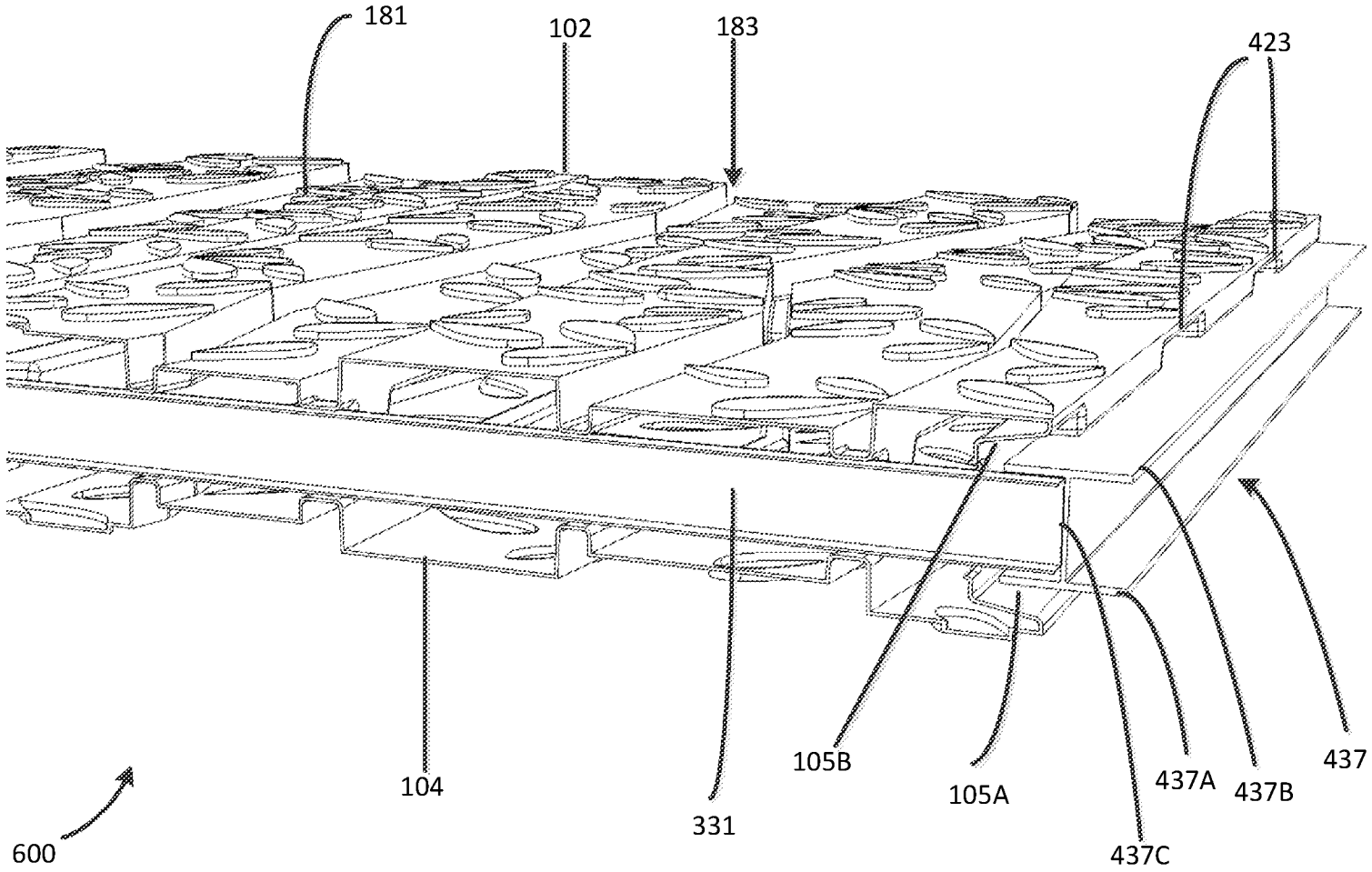
FIG. 8 is a cross-section view of a section of the sound attenuation barrier of FIG. 6A, shown receiving a reinforcement beam.
Figure 13:
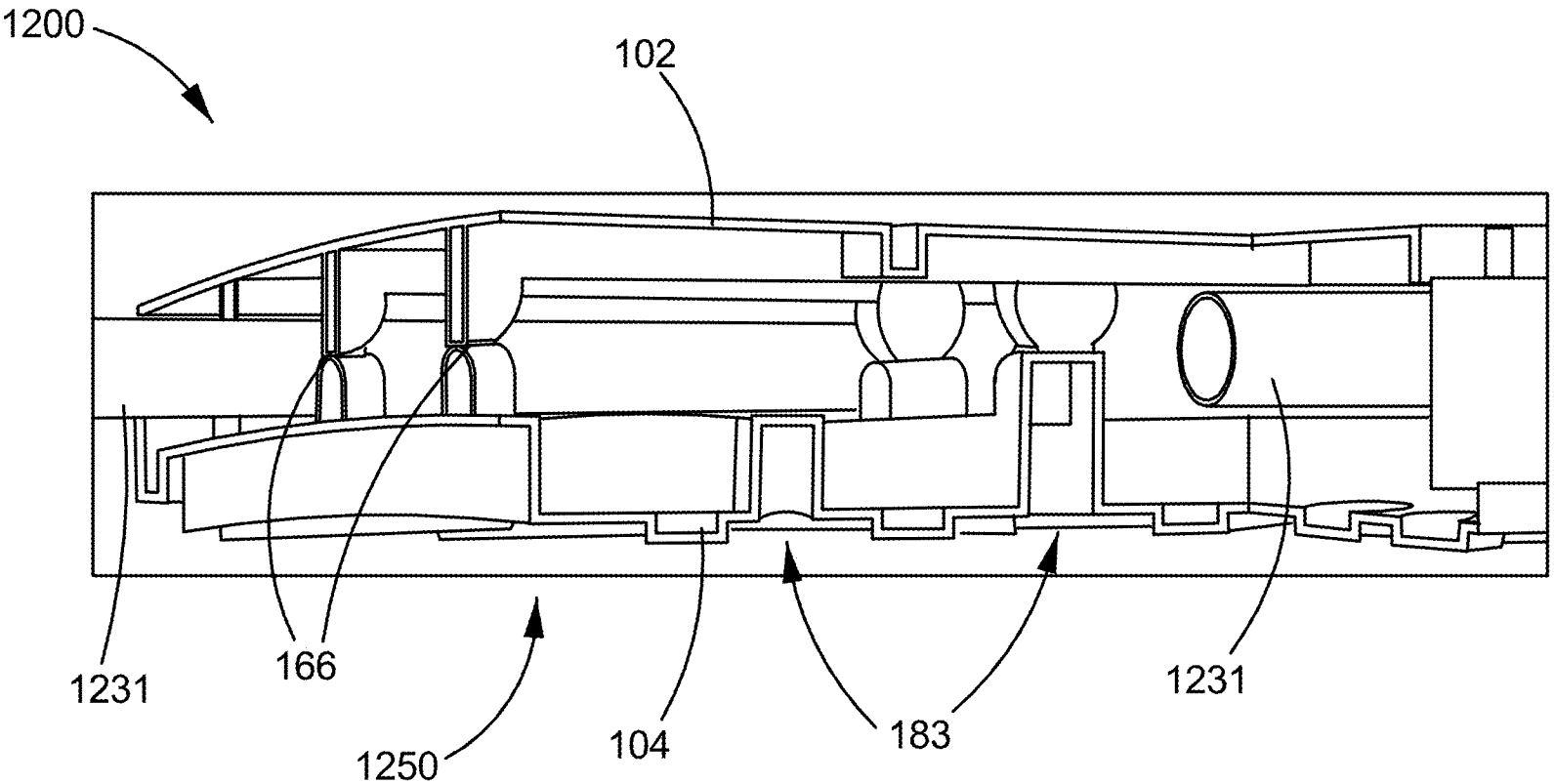
FIG. 13 is a cut-away perspective view of one end of the panel and two reinforcing beams of FIG. 12.
Figure 14:
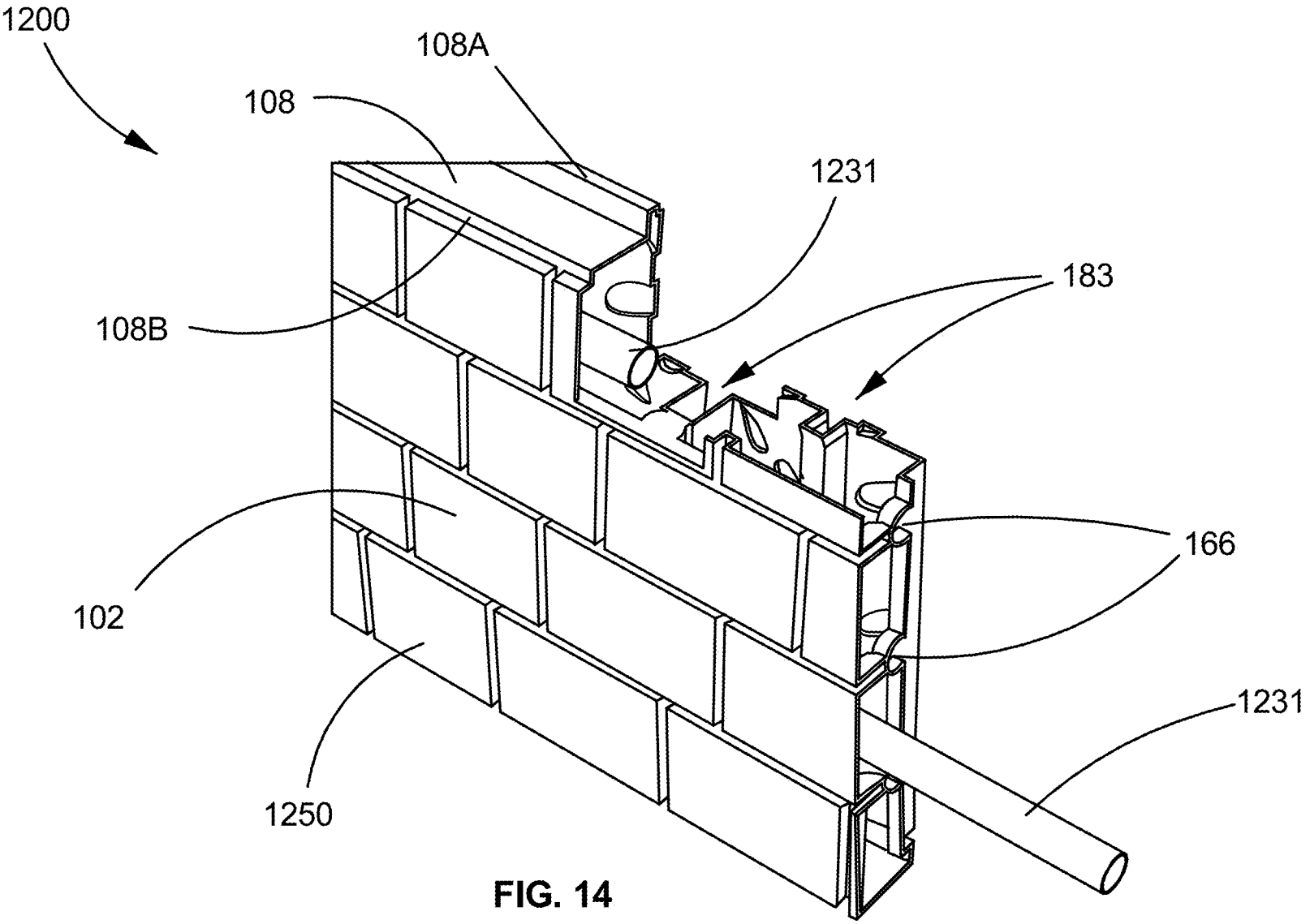
FIG. 14 is a partial cut-away perspective view of the panel and two reinforcing beams of FIG. 12.

Referring now to FIGS. 7 and 8, the cavity within the panel 100 has several bridging portions 166, also sometimes called kiss-offs, where the first major side wall 104 bridges with the second major side wall 102. The bridging portions 166 comprise two opposed bridging portions 166A (part of the side wall 104) and 166B (part of the side wall 102). The bridging portions 166A, 166B, when viewed from outside the panel 100, appear as depressions and when viewed from inside the panel 100 appear as projections. Both 166A and 166B when viewed from inside the panel 100 have a broader section closer to the side walls and a narrower section as they approach and meet each other. Bridging portions 166A and 166B may be thin (e.g. 10-40 mm thickness) and rounded or semi-circular in aspect. Planes generally defined by sides of the rounded or semi-circular aspects of the bridging portions 166A, 166B may be substantially parallel to each other as shown in FIG. 7. In other embodiments, the planes generally defined by sides of the rounded or semi-circular aspect of the bridging portions 166A and 166B may be angled, such as substantially perpendicular to each other, for example as shown in FIGS. 13 and 14. These bridging portions 166 provide added strength and rigidity to the panel 100 and facilitate the transfer of heat between the side walls 102 and 104, which helps keep visual changes in the panel due to temperature variations relatively hidden. The bridging portions 166 are positioned so that the passage between the apertures 117A-117B, 118A-118B and 119A-119B are not blocked. FIG. 8 is a cross-section view of the panel 100 which shows the reinforcement beam 331 passing through the apertures 117A and 117B and received in the recess 471 of the supporting beam 437.

Figure 9A:
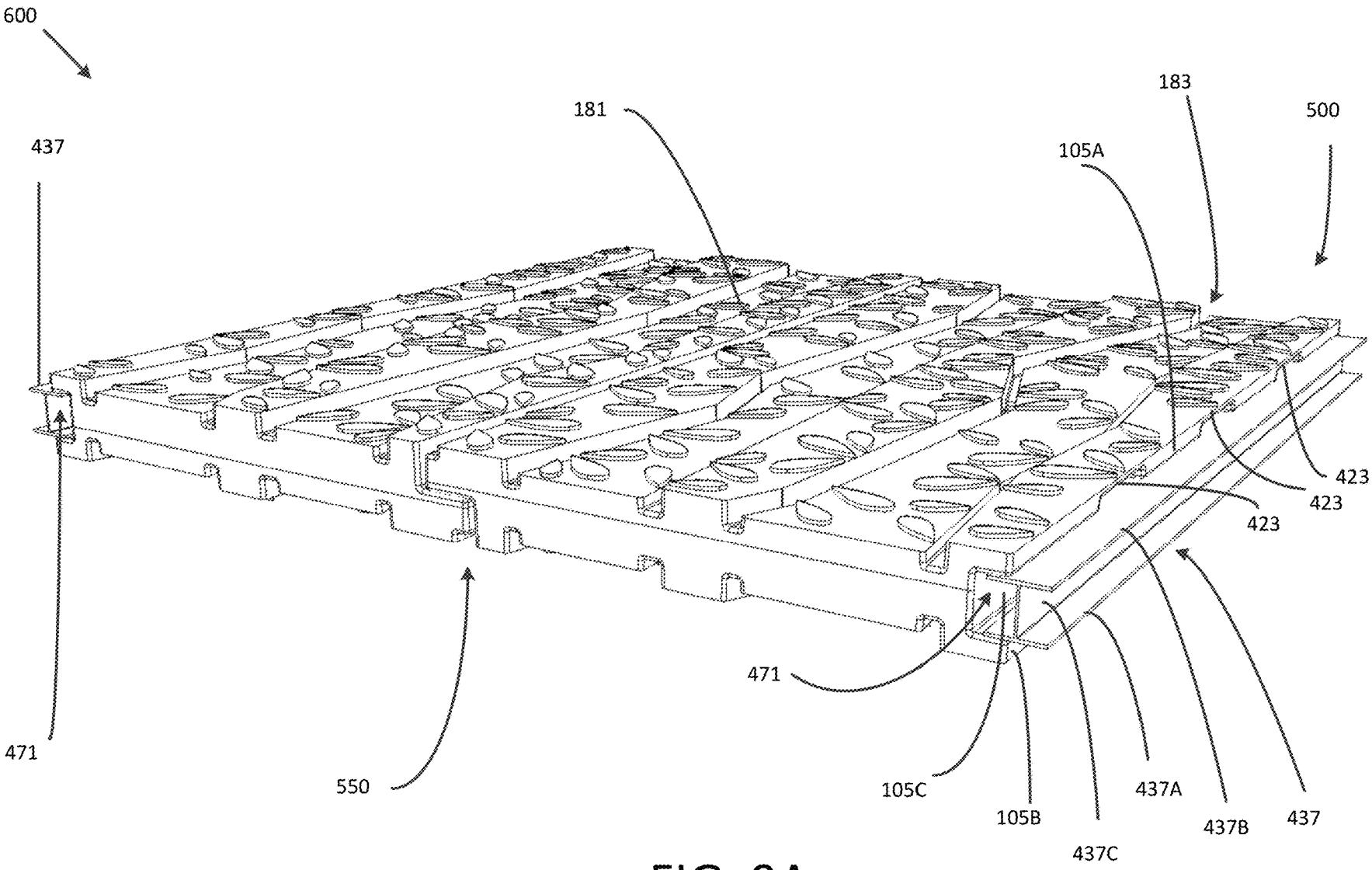
FIG. 9A is a perspective view of the sound attenuation barrier of FIG. 6A.
Figure 9B:
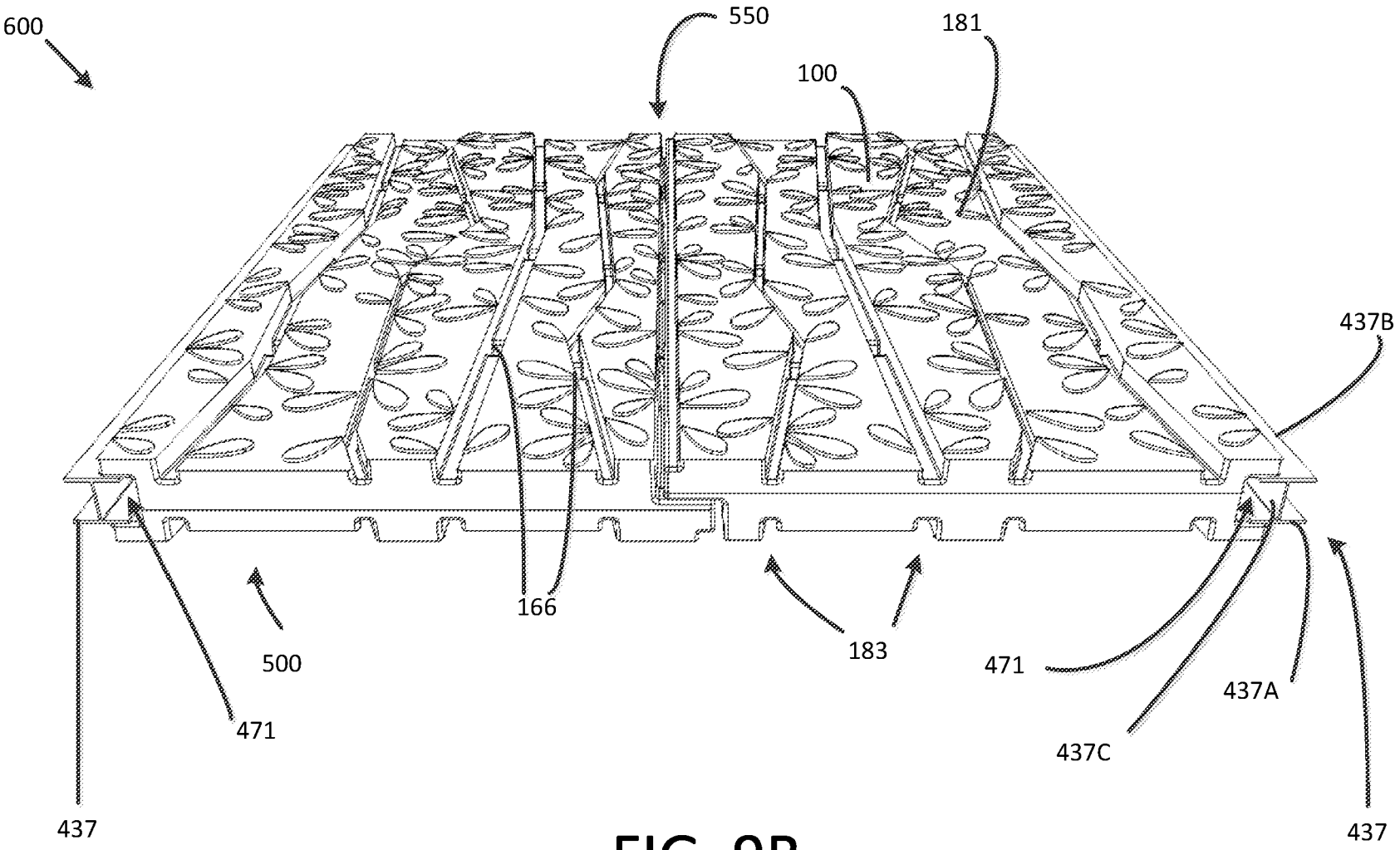
FIG. 9B is a perspective view of the sound attenuation barrier of FIG. 6A.

Referring now to FIGS. 9A and 9B, the panel assembly 500 will be now described according to some embodiments. The projecting structures 153 of the panels 100 in FIGS. 9A and 9B are aligned to form continuous passages through the minor end walls of the panels so that a reinforcing beam 331 can be received in the continuous passage created. The projecting portions of the reinforcing beams (not shown) rest in the recess 471 formed by the flanges 437A and 437B and the base of the supporting beam 437C. The two panels of the panel assembly 500 are mated together at the panel mating overlay 550 that brings the two panels together to form part of a continuous sound attenuation barrier 600.

Figure 10:
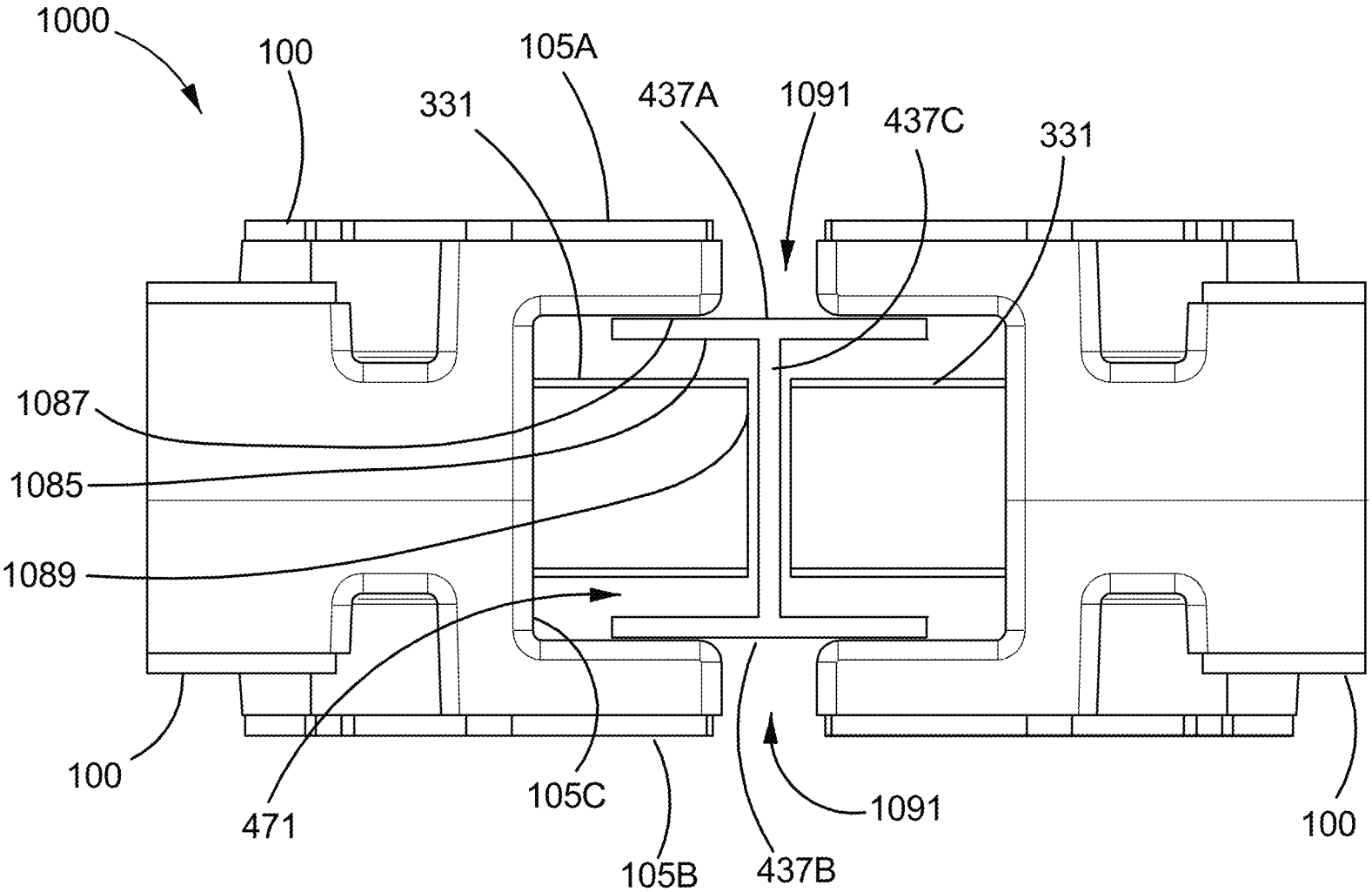
FIG. 10 is a top view of a vertical support, shown supporting two panel assemblies of FIG. 5 and receiving two reinforcing beams.

Referring to FIG. 10, the projecting portion of the supporting beam 437A is received between the inner face of the flanges 105A and 105B of two panels 100. Reinforcing beams 331 rest inside the recesses 471 created on either sides of the supporting beam 437 by the flanges 437A and 437B along with the web 437C. This overall structure permits two panel assemblies 500 to be tiled next to each other to form a continuous sound attenuation barrier 1000. The spacing between the vertical supports 437 and the lengths of the panels 100 is chosen to create a small gap 1091 (at the front and/or back of the barrier 1000) between the outermost end faces of two panels 100 adjacently positioned on opposing sides of the vertical support 437. The gap 1091 lies along the outer faces of the flanges 437A or 437B. The gap 1091 provides room for expansion or contraction for the panel 100 or the reinforcing beam 437 with temperature variations. Depending on temperature conditions, the width of the gap 1091 may vary between about 20 mm and about 80 mm wide in some embodiments, for example.

Figure 11B:
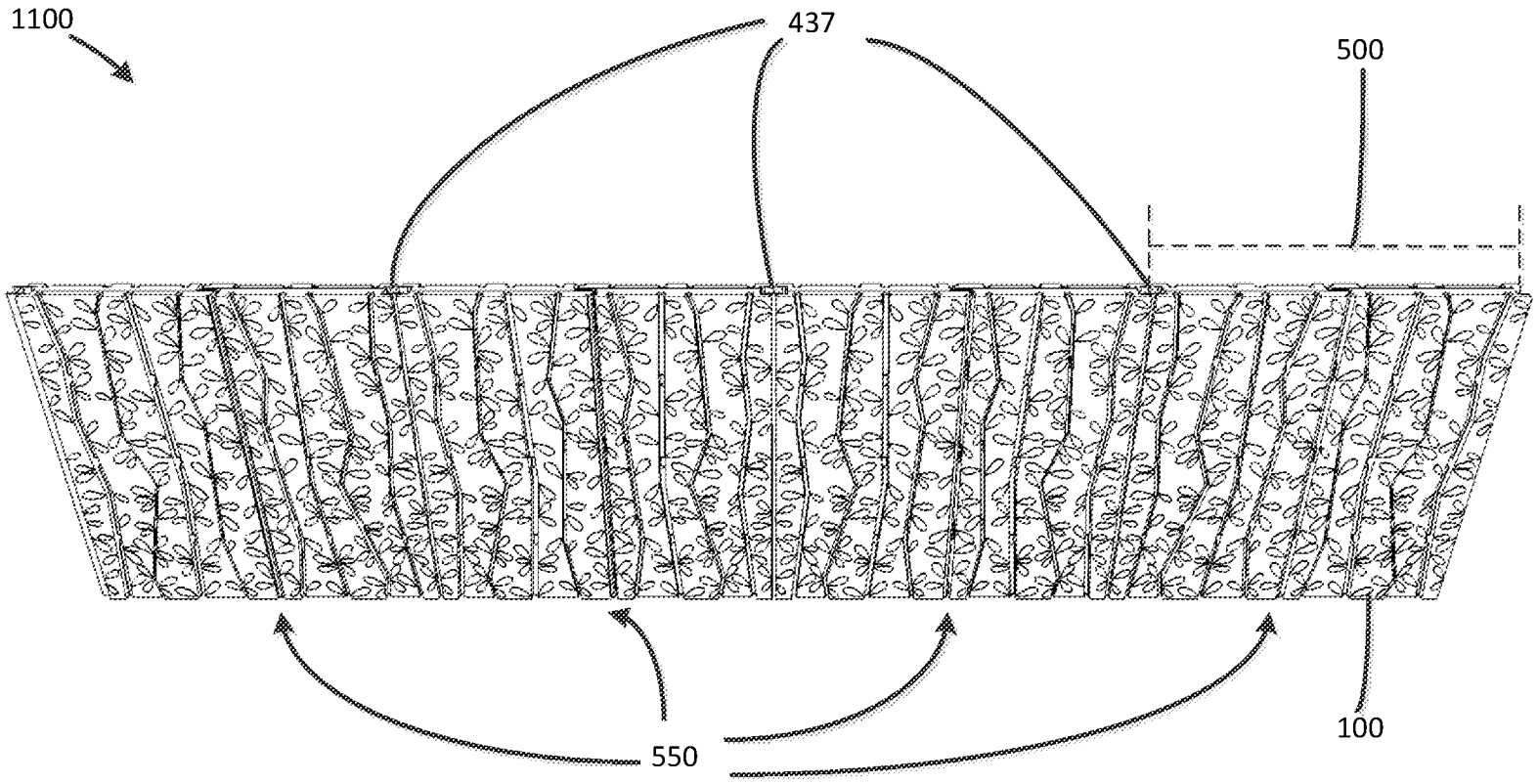
FIG. 11B is a perspective view of a sound attenuation barrier of FIG. 11A.
Figure 11C:
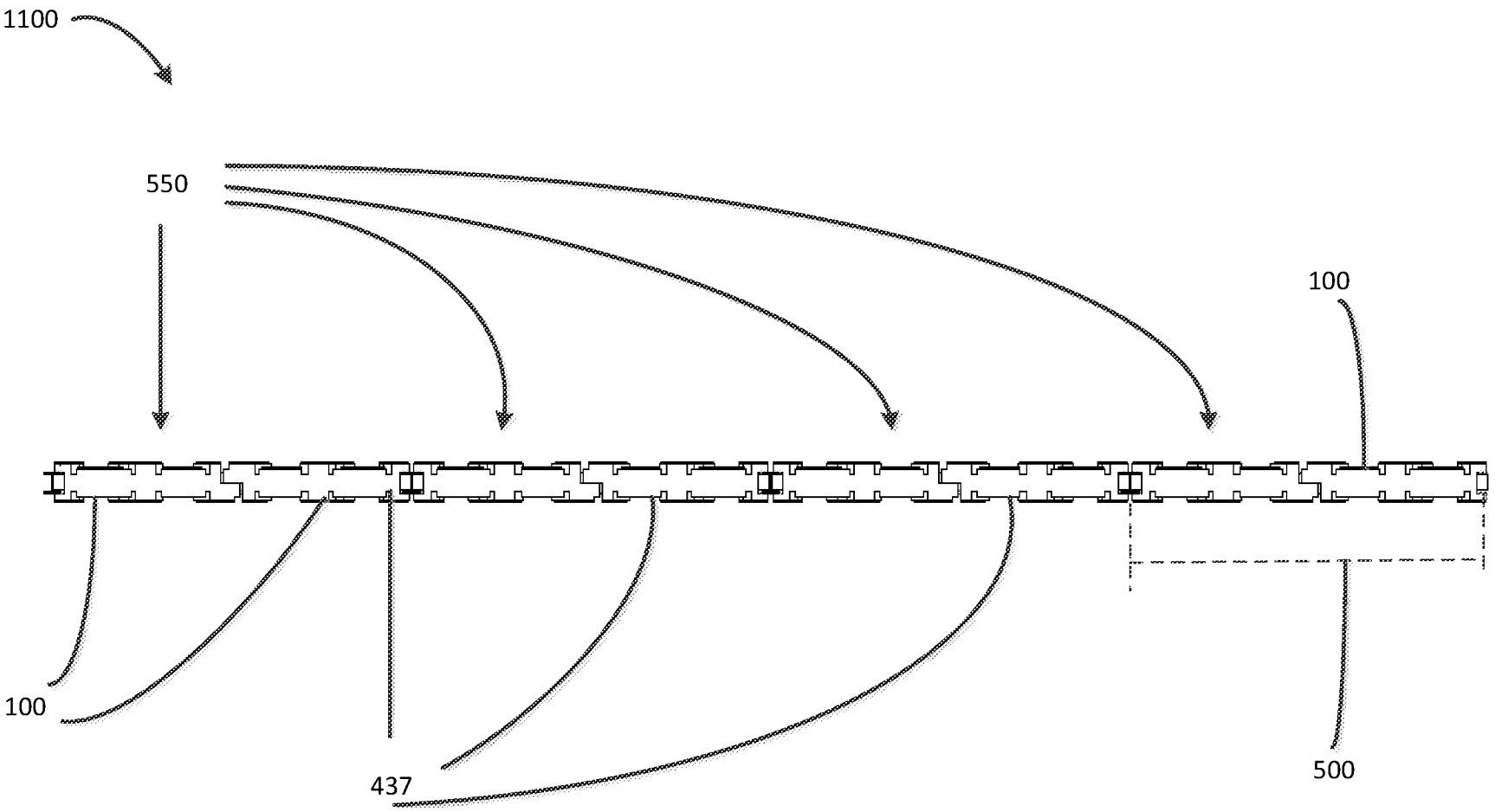
FIG. 11C is a cross section view of the sound attenuation barrier of FIG. 11A.

As shown in FIGS. 11A, 11B and 11C a sound attenuation barrier 1100 comprises several panel assemblies 500 tiled through multiple supporting beams 437. The panel assemblies are in turn formed by panel mating overlays 550 that mate two panels 100 to form a panel assembly 500.

Figure 12:
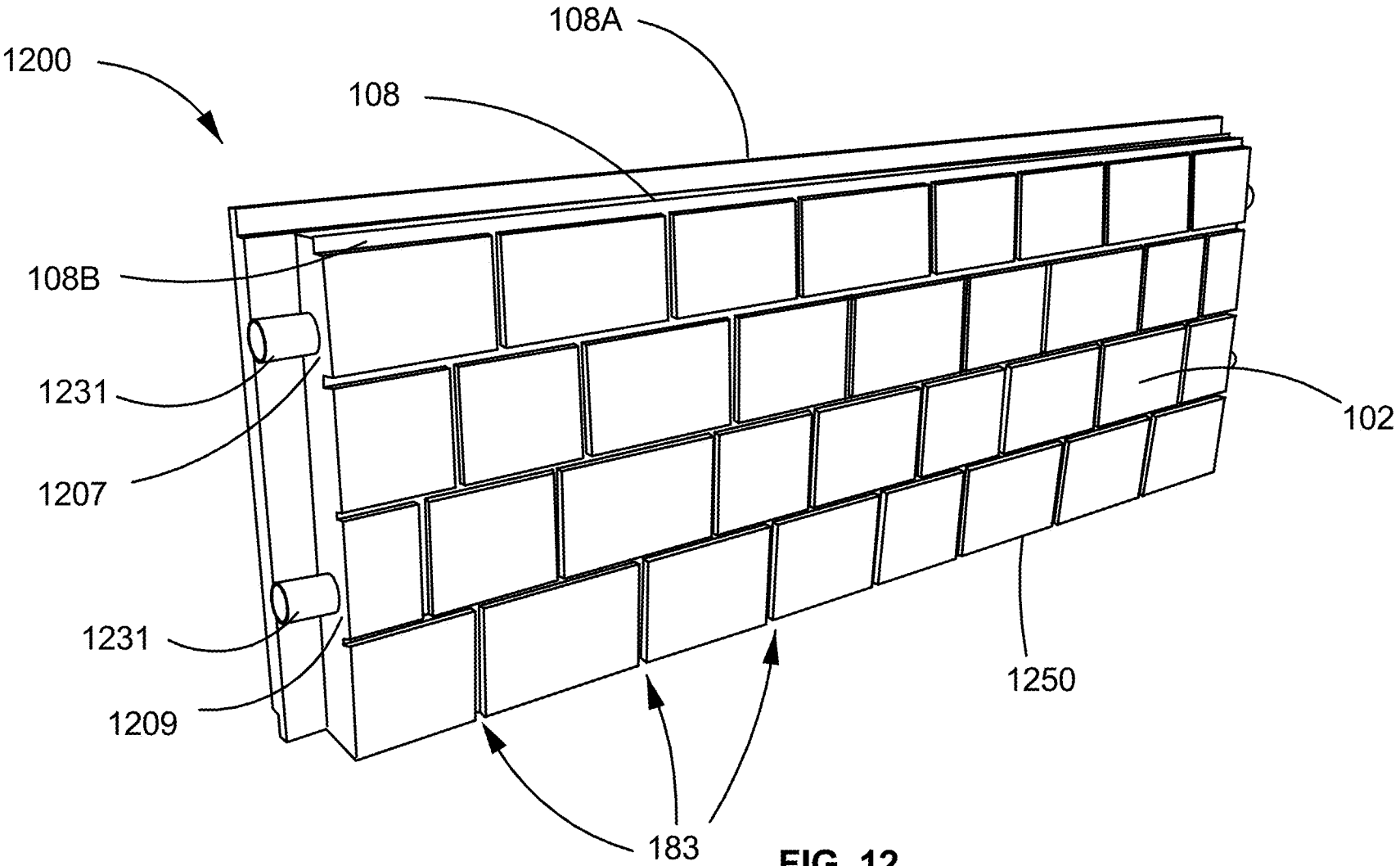
FIG. 12 is a perspective view of a panel according to further embodiments, including two reinforcing beams.

As shown in FIGS. 12, 13 and 14, some panel embodiments, such as panel 1250, may have a brick like pattern on the second major side walls formed by channels 183 in a brick like pattern. The reinforcing beams 1231 in some embodiments may have a cylindrical shape rather than the elongate bar shape of reinforcing beams 331. The panel 1250 does not have the projecting structure 153 and the projecting tongue 103B of panel 100 that forms part of the panel mating overlay 550 in the panel assembly 500. FIG. 12 represents a barrier 1200 comprising the panel 1250 and two reinforcing beams 1231 received through the apertures 1207 and 1209.

FIGS. 13 and 14 represent a cross section view of a panel 1250 through both the minor top wall and the first minor end wall and the reinforcing beams 1231. The minor top wall face 108 has a projection 108A and a depression 108B. The minor bottom wall face 106 (not shown) has corresponding projections and depressions that, together with the depression and projection in the minor top face 108, define a vertical mating structure that allows multiple panels 1250 to be tiled on top of each other to form a continuous sound attenuation barrier.

Referring now to FIGS. 15A, 15B, 16 and 17, according to some embodiments the vertically extending support beam 1537 may be curved to give the sound attenuation barrier an overall curved shape. A concave side of the barrier may be faced toward a roadway, for example. The panel 1550 has projecting flanges 1637 on both end walls that extend laterally beyond the back face 102 of panel 1550. The projecting flanges 1637 are approximately in or parallel to the plane of the front face 104. The gap between the projecting portions of the cylindrical reinforcing beams 1231 that pass through the corresponding apertures of the panel 1550 and the projecting flange 1637 from the panel 1550 receives one end of a support flange 1537A of the support beam 1537 in a clearance (or near-clearance) fit. The support beam 1537 also comprises flange 1537B and a web 1537C that are also curved. The gap is chosen to be wide enough (e.g. in the order of about 7 to 12 mm to accommodate a flange thickness of 5 to 10 mm) to slidingly receive the panel 1550 between two curved supporting beams. In this embodiment, the mating structure defined by the projection 108A and the depression 108B also account for the curvature of the supporting beam 1537 and are angled to enable the tiling of panels 1550 on top of each other while following the overall curvature of the supporting beam 1537.

Figure 15A:
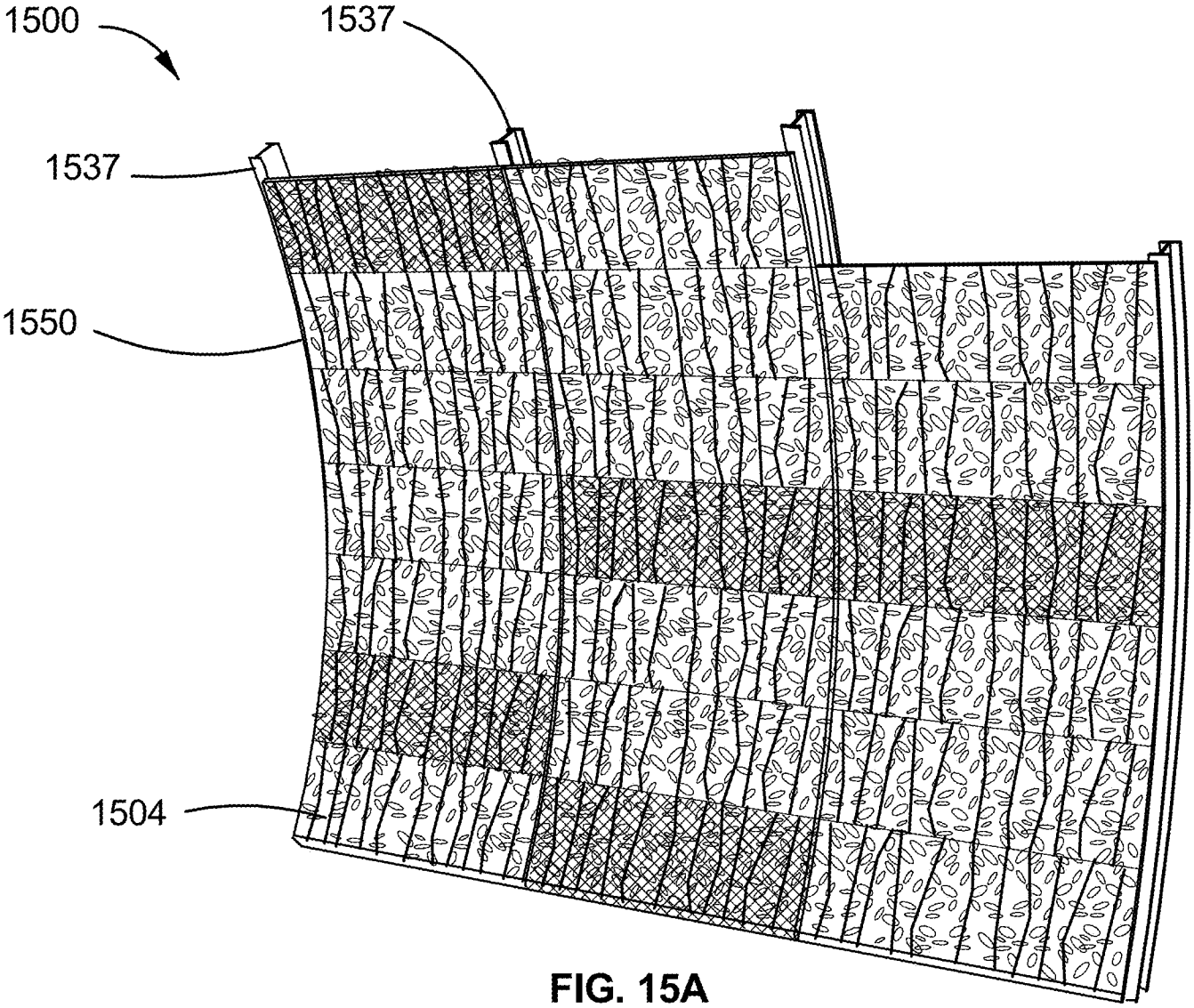
FIG. 15A is a front perspective view of a curved sound attenuation barrier according to some embodiments.
Figure 15B:
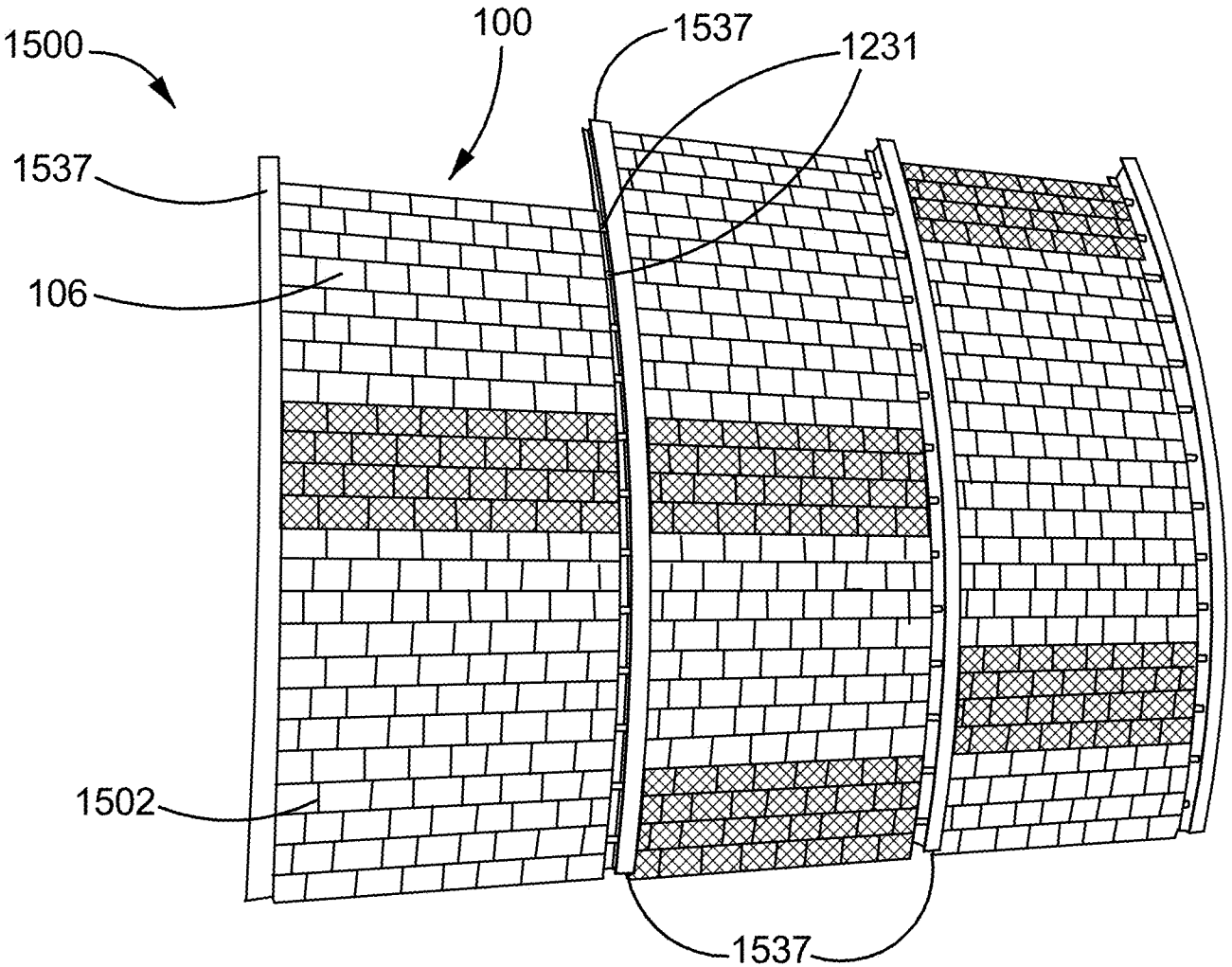
FIG. 15B is a back perspective view of the curved sound attenuation barrier of FIG. 15A.
Figure 16:
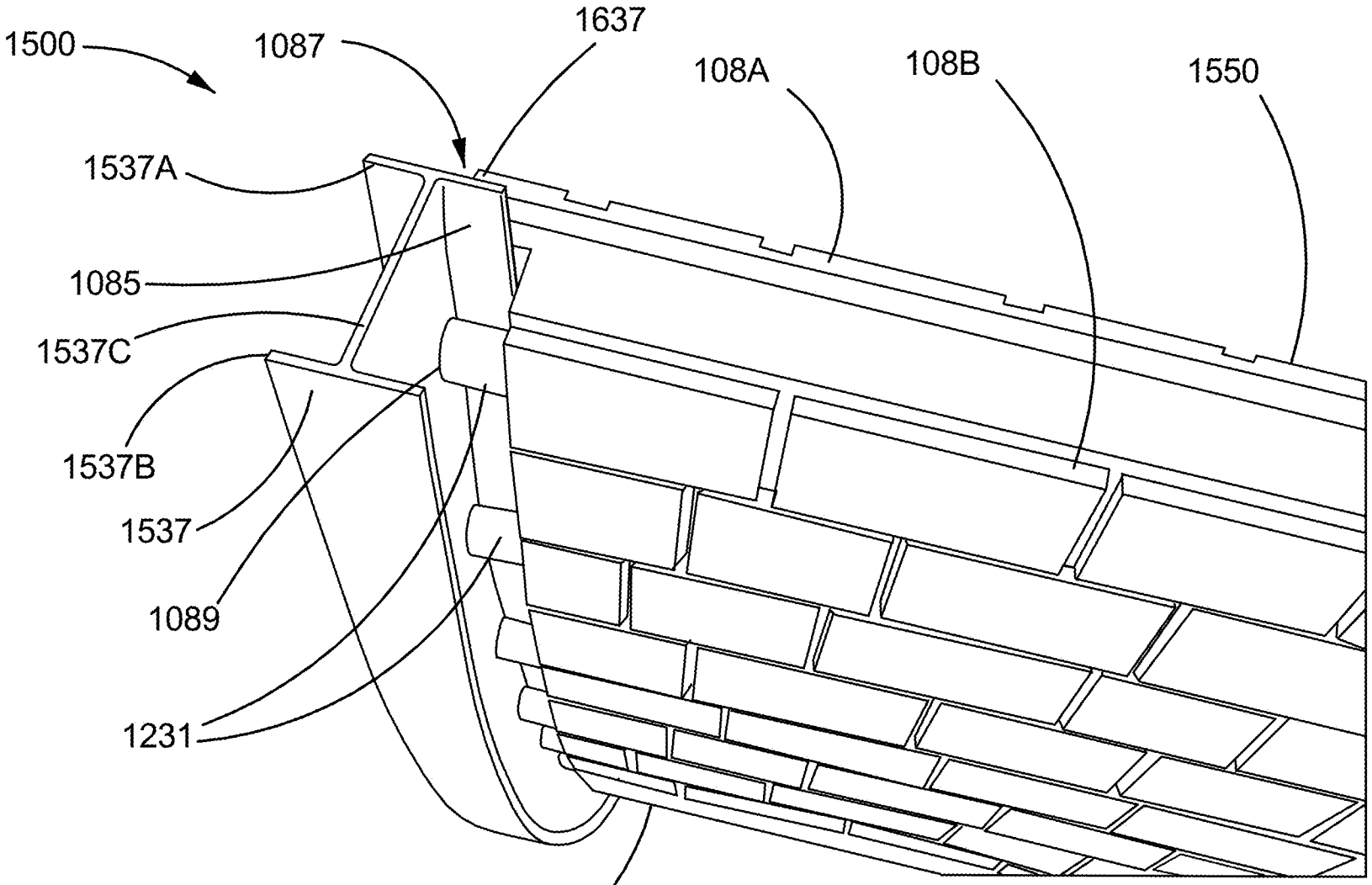
FIG. 16 is a top perspective view of the curved sound attenuation barrier of FIG. 15A.
Figure 17:
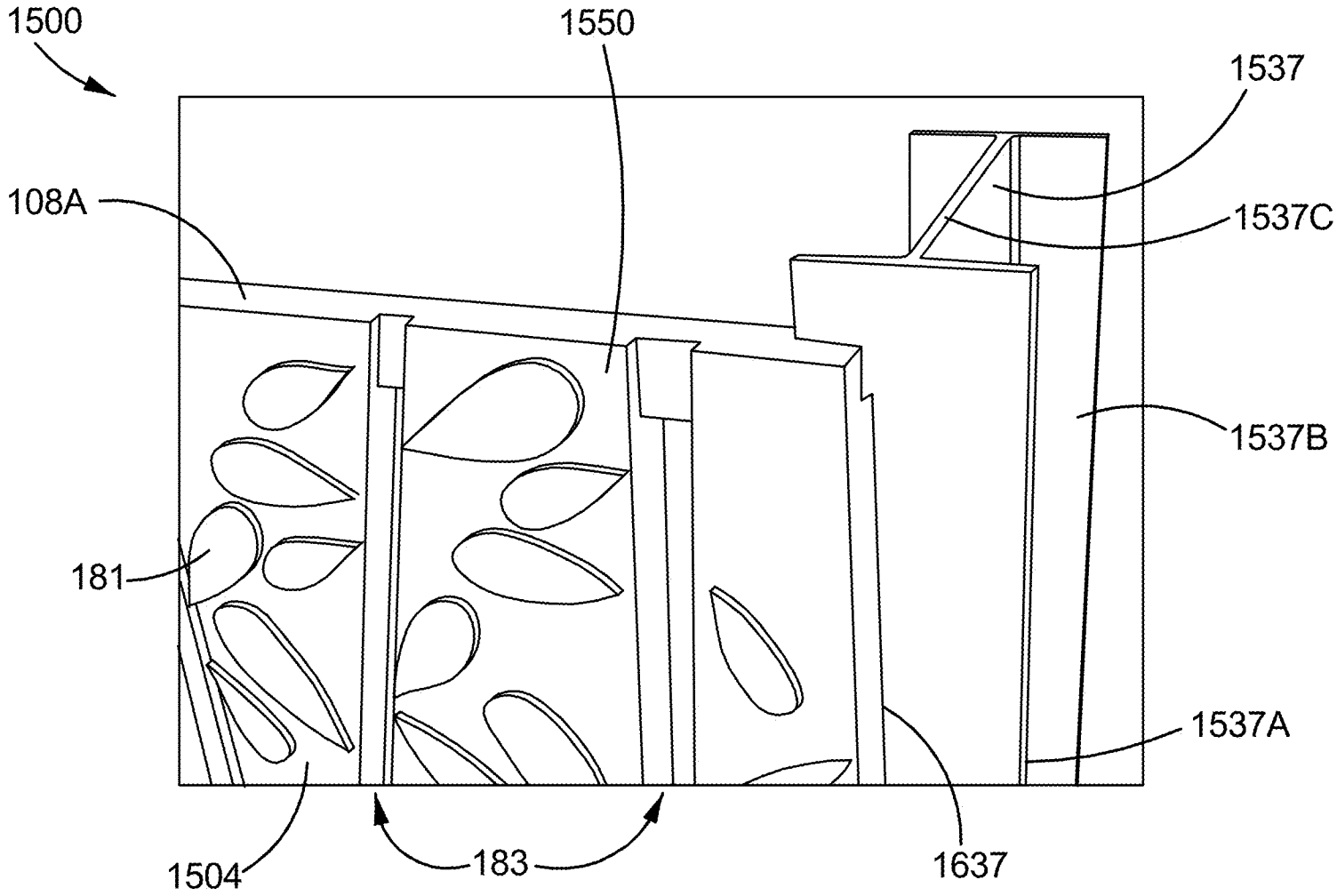
FIG. 17 is a perspective view of part of the curved sound attenuation barrier of FIG. 15A.
Figure 18A:
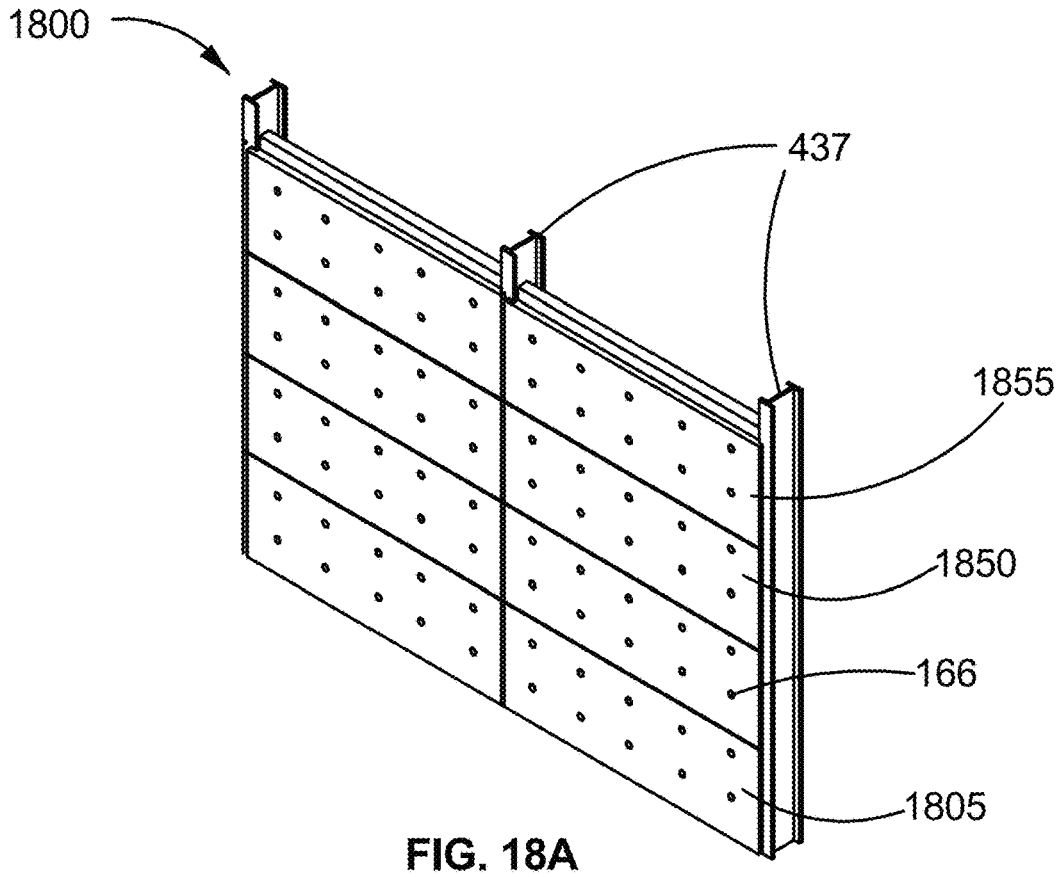
FIG. 18A is front perspective view of a sound attenuation barrier according to some embodiments.
Figure 18B:
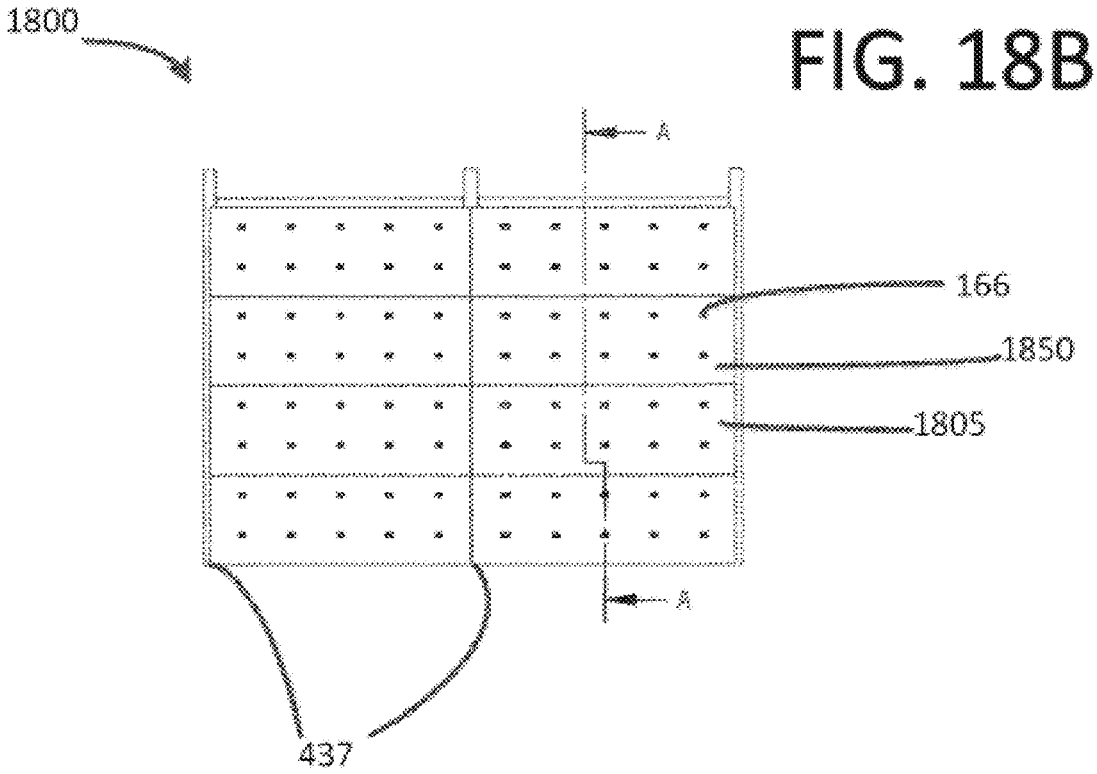
FIG. 18B is a front view of the sound attenuation barrier of FIG. 18A.

As best seen in FIGS. 15A and 15B, reference numeral 1500 is directed to a curved attenuating sound attenuation barrier formed by several panels 1550 extending between supporting beams such as 1537. The supporting beams such as 1537 and the projecting flanges 1637 in panels 1550 enable the horizontal tiling of multiple panels 1550 to form a sound attenuation barrier. Multiple panels 1550 are vertically tiled on top of each other through the projections 108A and the depressions 108B in the top wall face 108 of the panels and corresponding depressions and projections in the bottom wall face 106 of the panel. While the top wall face 108 and the bottom wall face 106 define mating structure for allowing mating and stacking of panels in a tiled configuration in a vertical direction, the mating takes place along a horizontal extent of the top and bottom tiled panels 1550. Although not shown, one or more sealing or cushioning strips may be located in between the adjacent top and bottom wall faces 108/106. A first major side wall 1504 has a first decorative pattern, for example in the shape of leaves and branches. A second major side wall 1502 has a second pattern, which may be different from the first pattern, for example in the shape of bricks. Individual panels in a sound attenuation barrier 1500 may have different colours and patterns on either of the front and back major side walls.

Referring to FIGS. 18A, 18B, 18C, 18D, 18E and 18F, a sound attenuation barrier 1800 comprises panels 1850 and supporting beams 437. The panel 1850, unlike panel 100, does not have a second minor end face with panel projecting structures 153 or a projecting tongue 103B. Both end walls of the panel 1850 have a projecting flange 1855. The first major side wall of 1805 of the panel 1850 bridges with the second major side wall 1815 at a plurality of bridging portions 166. These bridging portions 166 do not obstruct the passage formed between the apertures of either end walls of the panel 1850 through which reinforcing beams such as 331 are received to reinforce the panel.

FIG. 18C is a top view of the sound attenuation barrier 1800, showing the flange 437A of the support beam 437 on both sides received in the gap between the projecting flanges 1855 of the panel 1850 and the projecting reinforcing beam 331 in a clearance fit. FIG. 18D shows a magnified view of section B of the FIG. 18C. FIG. 18E is a cross section view of the sound attenuation barrier 1800 along the A-A line in FIG. 18B.

The top wall of the panel 1850 has a raised face 1803 and a depression 1807 to form a stair like structure on top. The bottom wall of the panel 1850 has equivalent receiving face 1809 with an extended projection 1811 that fits with the depression 1807 to form a stable vertical mating structure 1871. While mating structure 1871 is for allowing mating and stacking of panels in a tiled configuration in a vertical direction, the mating takes place along a horizontal extent of the top and bottom tiled panels 1850. Although not shown, one or more sealing or cushioning strips may be located in between the adjacent faces 1803/1809 and/or 1807/1811. As shown in FIG. 18F, a magnified version of section C of FIG. 18E; this stair like structure allows the vertical tiling of one panel on top of another through the vertical mating structure 1871 to form the sound attenuation barrier 1800. FIG. 18G is a magnified version of section D of FIG. 18E and shows the cross section of the rectangular elongate reinforcing beam 331 that lends structural reinforcing support to the panel 1850 between the supporting beams 437.

Some embodiments of panels 100 or 1250 or 1550 or 1850 may employ non-parallel top and bottom edges, for example giving each panel a somewhat trapezoidal appearance, with one end face being longer than the other, providing such panels can still be tiled with each other to form a sound attenuation barriers 600 or 1100 or 1500 or 1800. In some embodiments, the spaces between the flanges 437A and 437B of the supporting beam 437 and the projecting flanges 105A and 105B of the end wall 105 may be padded with a cushioning film 1087, such as a silicone strip of 2 mm thickness for example, to reduce vibrations between the panels 100, 1250, 1550, 1850 and the beam 437 when exposed to wind or other forces. Also, the space between the reinforcing beam 331 and the web of the I-beam 437C may be padded with a cushioning film 1089, such as a silicone strip of 2 mm thickness for example, to reduce or mitigate rattling or vibration of the panels 100, 1250, 1550, 1850 relative to the beam 437 in windy conditions. Also, the inner surfaces of the flanges of the I-beam 437A and 437B may be padded with a cushioning film 1085, such as a silicone strip of 2 mm thickness for example, to reduce or mitigate rattling or vibration of the reinforcing beam 331 against the flanges 437A and 437B.

The front face of the first major side wall 104 or the second major side wall 102 may be formed to have a textured external surface, as shown and described in relation to co-pending and co-owned International Patent Application No. PCT/AU2013/001177, the entire contents of which is hereby incorporated by reference. The textured external surface may have a stone (matte) appearance and may comprise a visually discernible pattern, such as geometric shapes or one or more symbols or parts of symbols. The one or more symbols may define one or more words or may convey a specific meaning, for example. Similarly, the back face of the second major side wall 102 may be formed to have a textured external surface. The back surface may have a stone (matte) appearance and may comprise a visually discernible pattern, such as one or more symbols or parts of symbols. Such symbols or parts of symbols may define one or more words or convey specific meanings. Formation of panel 100 by rotational moulding allows the creation of varied visually aesthetically appealing or meaningful indicia or patterns to be provided on external exposed front and back faces of front and back walls 104, 102 of the panel 100, which may provide added appeal in some circumstances. Additionally, such surface variations can assist in strengthening the panel walls and/or hiding or at least visually obscuring some expansion or contraction in the plastic wall panels due to environmental temperature variation.

The first and second minor end walls (105 and 103 respectively) of panel 100 have a length greater than the length of the top wall and the bottom wall. The length of the top wall or the bottom wall of panel 100 may be about or just under 1.5 metres (e.g. 120 to 145 cm), while the length of the first and second minor end walls may be about or just under three metres (e.g. 250 to 295 cm). The top wall and the bottom wall of specific embodiments of panel 100 may have a length in the range of 130 to 145 cm. The first and second minor end walls of specific embodiments of panel 100 may have a length in the range of 260 to 280 cm. The depth of the recess 127 relative to the remainder of the bottom of the end face 105 may be 40 to 50 millimetres, for example.

The end walls of each of the panels 1250 and 1550 and 1850 have a length smaller than the length of the top wall and the bottom wall of the respective panels. The length of the top wall or the bottom wall of panels 1250 or 1550 or 1850 may be about or just under 3 metres (e.g. 250 to 295 cm), while the length of the end walls may be about one metre (e.g. 80 to 95 cm). In specific embodiments, the length of the top wall or the bottom wall of panels 1250 or 1550 or 1850 may be in the range of 275 to 285 cm, while the length of the first and second minor end walls may in the range of 85 to 90 cm. The panel 1550 has a concave side wall 1504 and a convex side wall 1502. The height of the convex side wall is marginally greater than the concave side wall to account for the curvature of the barrier.

The thickness of the walls of panels 100, 1250, 1550, 1850 is nominally about 8 millimetres, although some small variation may occur across the different parts of the panel walls. Other panel embodiments may use a different nominal wall thickness, such as 6 to 10 millimetres, for example.

The maximum width of any of the panels 100 or 1250 or 1550 or 1850 between the first major side wall and the second major side wall may be around 150 to 250 millimetres or possibly around 180 to 230 millimetres, for example. Specific embodiments may have a width (measured at the top and the bottom edge faces 106, 108) of about 190 millimetres or about 200 millimetres.

The example dimensions given here may be varied, depending upon requirements, and are intended to only be generally indicative of the dimensions of some embodiments. Other embodiments can have different dimensions. For example, the length of panel 100 may be shorter, in the order of 1 or 1.25 metres or other lengths in between about 1.25 and 1.5 metres. The length of panel 100 may alternatively be longer than 1.5 metres, for example up to 1.75 or 2 metres or up to about 3 metres. Panels of such longer lengths will generally require suitable reinforcing structure, such as the support beams and/or other support framework described herein, in order to tolerate high wind loads.

In the context of this application, given that the plastic panels described herein are subject to thermal expansion and contraction and may also experience some degree of flexion, the term "about" applied to a dimension of a part or a structural component of a panel should be understood to include dimensions in a range, such as an absolute range or a percentage range like 1%, 2%, 3%, 4% or 5%, either side the specified dimension. For example, a length of "about 1.5 metres" may be understood to include lengths in the range of 50-100 mm more or less than 1.5 metres, which equates to a particular percentage range of variation.

Figure 19:
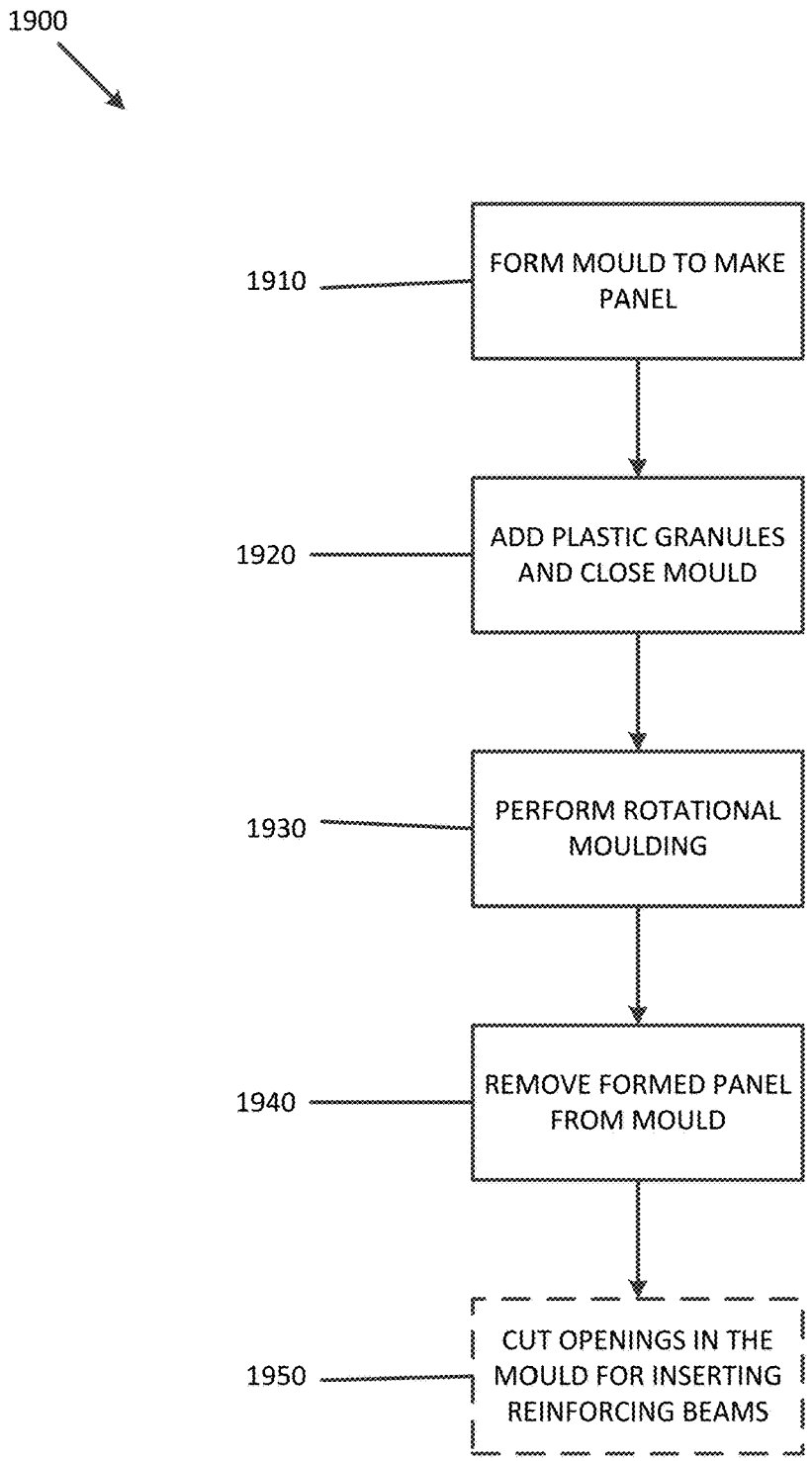
FIG. 19 is a flow chart of a method of forming a plastic panel according to some embodiments.

Referring now to FIG. 19, a method 1900 of forming a wall panel is described in further detail. At step 1910, a mould is formed. The mould must be suitable for use in rotational moulding and may be formed of machined aluminium plates, for example. The mould plates are preferably formed to have substantial uniform thickness from the back face of the mould to the front face of the mould in order to allow relatively uniform heat transmission through the material of the mould. Thus, where a particular design, texture, pattern and/or set of symbols is applied to the mould, both front and back faces of the mould plate should be machined accordingly.

The mould plates are formed at 1910 to define a hollow panel when moulded, having a length greater than a width, a thickness less than the width, a front wall, an opposite back wall and opposed first and second long edge regions. For embodiments of panel 100, the panel shape thus defined has a first end and a longitudinally opposite second end, with the first end region defining the face 103A and the projecting tongue 103B, and one recessed portion 129 to longitudinally receive and mate with the projecting tongue 103B of another panel. Moulds for embodiments of panel 1250, 1550 and 1850 do not define a projecting tongue 103B. The mould for panel embodiment 1250 comprises projections that define the channels 183 in a desired pattern, the projection 108A and the depression 108B. The mould for the panel embodiment 1550 is shaped to define the curvature in the panel embodiments along with a desired exterior pattern on the wall 1504, an alternate or similar pattern on the wall 1502, the projection 108A and depression 108B. Moulds for the panel embodiment 1850 also defines the stair like mating structure comprising the projection 1811 and the depression 1807 to allow the panels to be vertically stacked on top of each other. Moulds for all the panel embodiments also define bridging portions 166 to add strength and stability to the panels.

At step 1920, granules of a suitable polyolefin are added into the mould and the mould is closed tight. The polyolefin granules must be suitable for rotational moulding and may include polypropylene and polyethylene materials, for example. A particularly preferred polyolefin is polyethylene and preferred forms of polyethylene include those that can accommodate pigments and ultra violet radiation stabilizers (i.e. to provide a higher resistance to degradation under exposure to ultra violet radiation). One example of a polyethylene material that can be used is Qenos Alkathene 711 UV. Such polyethylene materials have a generally good chemical resistance to pollutants and can be more readily cleaned of graffiti than other materials, such as stone or concrete panel materials. Panel shells formed of such polyethylene materials may also have an anti-graffiti coating applied thereto, such as a coating provided by APP of Keysborough, Victoria, Australia. Such polyethylene materials are also readily cleanable, for example by a water jet, and do not stain or burn easily. Particular forms of polyethylene that may be suitable include linear low density polyethylene and medium density polyethylene. In some embodiments, high density polyethylene may also be used. In embodiments employing polyethylene or polypropylene as the material for the panel shell, the polyethylene or polypropylene material added into the mould preferably contains suitable additives for UV resistance and/or pigmentation and/or graffiti resistance.

Sound attenuation properties of panels according to described embodiments are designed to meet the requirements of the relevant Australian and/or international standards. For example, attenuation of sound through described panel embodiments may be at least about 25 decibels at frequencies between 250 Hz and 5000 Hz.

At step 1930, the panel 100 is formed using conventional rotational moulding techniques, including heating the mould while rotating it around two different axes of rotation so that the polyolefin granules melt and accrete on the inside surfaces of the mould plates. This heating and rotation is performed for a set period of time, following which the mould is cooled and then, at 1940, the formed panel is removed from the mould.

At step 1950, apertures 117A, 117B, 118A, 118B, 119A and 119B are cut into the panel 100 to allow the panels to receive reinforcement structures 331. These apertures are positioned such that any two or more reinforcement structures passing through them will be substantially parallel to each other.

While described embodiments are considered to be particularly suitable for sound attenuation barriers, some embodiments are directed more generally to wall panels that can be used in different ways. For example, described embodiments may be used as panels for cladding of buildings or to form an exterior face or design on a building, since they are light, easily transportable and can be readily customised. Further, rotational moulding of such panels can provide significant advantages over traditional concrete panel forming.

A further advantage of panel embodiments described herein is that they are formed of a recyclable plastic that can be readily separated from associated reinforcing of support structure for recycling, if desired.

Figure 20:
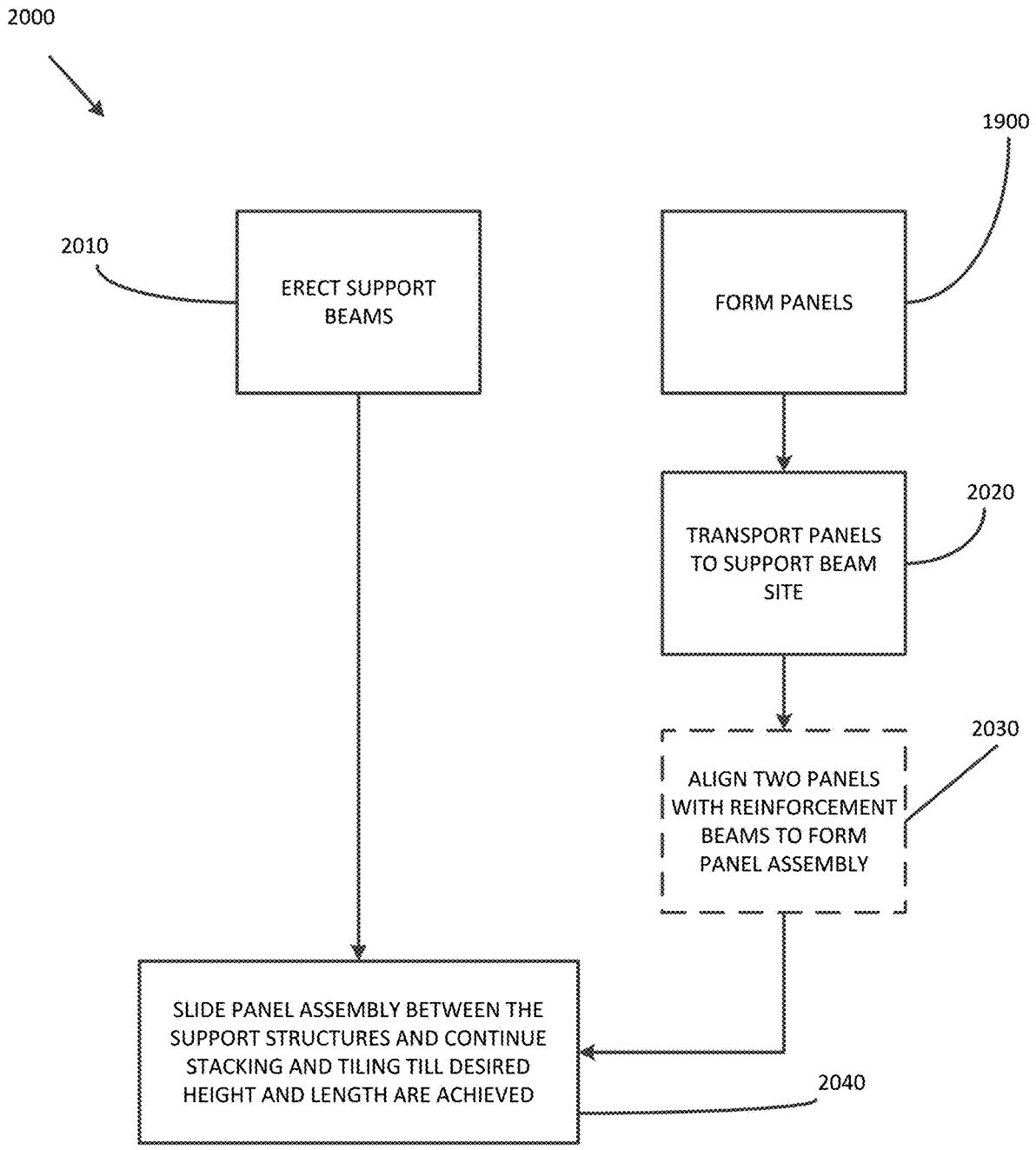
FIG. 20 is a flow chart of a method of assembly of a sound attenuating barrier according to some embodiments.

Referring also to FIG. 20, a method 2000 of forming a wall structure using described panel embodiments is described in further detail. Method 2000 involves the formation of panels according to method 1900. Contemporaneously with the panel formation, support structure may be erected on a chosen site at step 2010. The formed panels are transported to the site with support beams at step 2020. At step 2030 two panels are aligned to form the panel assembly 500 and one or reinforcement structures can be received in the panel assembly to further strengthen it. At step 2040, the composite panel 500 is slid between the support beams 437 such that the reinforcement beams are received in the recesses 471 and the support beams are received in the recess 127 of the panels 100. After the first panel assembly is positioned in place, additional panel assemblies can be stacked on top of the first positioned panel assembly to erect a sound attenuation barrier of desired height. Panel embodiments such as 1250, 1550 and 1850 without the mating structures 153 and the projecting tongue 103B do not require the assembly step of 2030.

The construction of the panel embodiments described above enables easier assembly of sound attenuation barriers. No specific clamping or affixing components to the reinforcing beams 331 or the supporting beams are necessary to assemble the sound barrier. The reinforcing beams 331 can be slid inside the panel and by virtue of the positioning between two vertical supporting beams 437, the entire sound barrier can be positioned in a stable formation. No specific perforations need to be formed in the supporting I-beams 437 to affix the panels. The construction of the panel assembly 500 by mating two panels 100 increases the distance between two supporting beams 437 that might otherwise be placed between a single panel 100. This construction of a sound barrier reduces the need for supporting beams at closer spacing intervals and the labour associated with erection of supporting beams per unit length of a sound barrier. Panel assemblies 500 can be lifted over the top of vertical supports 437 and then slid or slotted down in position (as in FIG. 10) under gravity, to give the vertical wall arrangements illustrated in FIG. 11A, for example.

The vertical tiling of panels as described for sound attenuation barriers 1500, 1800 can also be achieved without any perforations to screw in or clamp panels to the vertical supports 437. Advantageously, this construction reduces the complexity of the labour and construction necessary in erection or repair or replacement of sound attenuation barriers. Panels 1250, 1550, 1850 or panel assembly 500 may be lifted using a sling, such as a canvas sling (since the panels are light-weight, e.g. less than 100 kg), which may be attached via cables to lifting equipment such as a crane and positioned to be slidingly slotted down and received between vertical supporting beams 437. In some embodiments, a cap may be clamped over the uppermost panel 1250, 1550, 1850 adjacent or toward a top region of the vertical supports 437.

Embodiments have been described generally herein by way of non-limiting example. Thus, this detailed description should be taken as illustrative and not restrictive, taking into account that some variation or modification of the described embodiments is possible without departing from the spirit and scope of the invention or inventions described herein.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A plastic wall panel, comprising:

a hollow body having external walls and defining an internal cavity, the external walls including: a first major side wall, a second major side wall opposite the first major side wall, a minor top wall, a minor bottom wall, a first minor end wall and a second minor end wall opposite the first minor end wall;

wherein the minor top wall and the minor bottom wall each define mating structure to mate and align with another adjacent one of the panel so that multiple ones of the panel can be tiled together to form at least part of a sound attenuation barrier, wherein the hollow body defines a passage extending between the first and second major side walls and through the first and second minor end walls, wherein the first and second minor end walls define respective first and second beam apertures, and wherein the first and second beam apertures and the passage are configured to receive a reinforcing beam therein.

2. The panel of claim 1, wherein the passage is a first passage and the hollow body further defines a second passage wherein the hollow body defines a passage extending between the first and second major side walls and through the first and second minor end walls, and wherein the first and second minor end walls define respective third and fourth beam apertures, and wherein the third and fourth beam apertures and the second passage are configured to receive a second reinforcing beam therein.

3. The panel of claim 1, wherein the first and second minor end walls have a first length that is less than a second length of the minor top wall and the minor bottom wall.

4. The panel of claim 1, wherein the panel is rotationally moulded.

5. The panel of claim 1, further comprising the reinforcing beam received in the passage and extending through the first and second minor end walls.

6. The panel of claim 1, wherein the passage is open to the cavity.

7. The panel of claim 1, further comprising at least one bridging portion where the first major side wall meets the second major side wall, the at least one bridging portion being located between the minor bottom and top walls and between the first and second minor end walls.

8. The panel of claim 1, wherein the first major side wall is formed to define a front face and the second major side wall is formed to define a back face, wherein the first and second minor end walls each define respective first and second projecting flanges that extend laterally beyond a lateral extent of the back face.

9. The panel of claim 8, wherein the first and second beam apertures and the passage are configured to receive the reinforcing beam in a clearance fit, and wherein a spacing between the first beam aperture and the first projecting flange is arranged to receive a support flange of a support structure in a clearance fit.

10. A plastic wall panel, comprising:

a hollow body having external walls and defining an internal cavity, the external walls including: a first major side wall, a second major side wall opposite the first major side wall, a minor top wall, a minor bottom wall, a first minor end wall and a second minor end wall opposite the first minor end wall;

wherein the hollow body defines a passage extending between the first and second major side walls and through the first and second minor end walls, wherein the first and second minor end walls define respective first and second beam apertures, and wherein the first and second beam apertures and the passage are configured to receive a reinforcing beam therein;

wherein the first minor end wall has a different shape from the second minor end wall, the second minor end wall defining mating structure to mate and align with corresponding mating structure of the second minor end wall of another adjacent one of the panel so that multiple ones of the panel can be tiled together to form at least part of a sound attenuation barrier.

11. The panel of claim 10, wherein the passage is a first passage and the hollow body further defines a second passage extending between the first and second major side walls and through the first and second minor end walls, and wherein the first and second minor end walls define respective third and fourth beam apertures, and wherein the third and fourth beam apertures and the second passage are configured to receive a second reinforcing beam therein.

12. The panel of claim 10, wherein the first and second minor end walls have a first length that is greater than a second length of the minor top wall and the minor bottom wall.

13. The panel of claim 10, wherein the first and second beam apertures and the passage are configured to receive the reinforcing beam in a clearance fit.

14. The panel of claim 10, wherein the first major side wall is formed to define a front face and the second major side wall is formed to define a back face, wherein the first and second minor end walls each define a respective first and second projecting flanges that extend laterally beyond at lateral extent of the back face.

15. A panel assembly comprising the panel of claim 10 and the another panel, wherein when the panel is mated and aligned with the another panel, the passage of the panel is aligned and communicates with the passage of the another panel so that the reinforcing beam is receivable through both passages.

16. A wall section, comprising first and second plastic wall panels of claim 10, wherein the mating structure of the first panel is mated and aligned with the mating structure of the second panel.

17. The wall section of claim 16, further comprising the reinforcing beam received through the passage of each of the first and second panels.

18. The wall section of claim 17, wherein the reinforcing beam is a first reinforcing beam and the passage is a first passage and the hollow body of each panel defines a second passage spaced from the first passage, the second passage receiving a second reinforcing beam in a substantially parallel orientation with the first reinforcing beam.

19. The wall section of claim 18, wherein the first and second passages extend through spaced upper and lower central regions of the cavity.

20. A method of forming a barrier, comprising:

arranging a reinforcing beam to extend through the passage of each of a plurality of the panels of claim 1; and positioning each of the panels in tiled and slotted relation to flanged vertical supports, wherein a plurality of the panels are held in vertical positions by a flange of the flanged vertical support being received between an end flange of the panel and the reinforcing beam.

21. A method of forming a barrier, comprising:

arranging a reinforcing beam to extend through the passage of each of a plurality of the wall sections of claim 17; and positioning each of the wall sections in tiled and slotted relation to flanged vertical supports, wherein a plurality of the wall sections are held in vertical positions by a flange of the flanged vertical support being received between an end flange of the wall section and the reinforcing beam.

* * * * *